US006932040B2

(12) United States Patent
Kadokawa et al.

(10) Patent No.: US 6,932,040 B2
(45) Date of Patent: Aug. 23, 2005

(54) METAL PLATE ROCKER ARM AND METHOD OF MANUFACTURING THE METAL PLATE ROCKER ARM

(75) Inventors: Satoshi Kadokawa, Fujisawa (JP); Noriyuki Takeo, Fujisawa (JP); Yoshihiro Saito, Namerikawa (JP); Shinobu Shimada, Namerikawa (JP)

(73) Assignees: NSK Ltd., Tokyo (JP); Toho Industrial Co., Ltd., Toyama (JP)

( * ) Notice: Subject to any disclaimer, the term of this patent is extended or adjusted under 35 U.S.C. 154(b) by 0 days.

(21) Appl. No.: 10/475,171

(22) PCT Filed: Apr. 19, 2001

(86) PCT No.: PCT/JP01/03348

§ 371 (c)(1),
(2), (4) Date: Mar. 11, 2004

(87) PCT Pub. No.: WO02/085554

PCT Pub. Date: Oct. 31, 2002

(65) Prior Publication Data

US 2004/0134065 A1 Jul. 15, 2004

(51) Int. Cl.[7] ..... F01L 1/18
(52) U.S. Cl. ..... 123/90.39; 29/888.2
(58) Field of Search ..... 123/90.41, 90.43, 123/90.51, 90.39; 29/888.2

(56) References Cited

U.S. PATENT DOCUMENTS 6,199,527 B1 * 3/2001 Okubo et al. ..... 123/90.41
6,332,904 B1 * 12/2001 Fujiki et al. ..... 75/243

FOREIGN PATENT DOCUMENTS

| | | |
|---|---|---|
| JP | 3-172506 | 7/1991 |
| JP | 11-63515 | 3/1999 |
| JP | 11-270311 | 10/1999 |
| JP | 2001-65313 | 3/2001 |
| JP | 2001-129633 | 5/2001 |

* cited by examiner

*Primary Examiner*—Thomas Denion
*Assistant Examiner*—Z Eshete
(74) *Attorney, Agent, or Firm*—Miles & Stockbridge P.C.

(57) ABSTRACT

A sheet-metal rocker arm formed by the steps of punch-pressing a sheet of metal member to form a blank having a predetermined shape and a through-hole, of subjecting the blank to a bending process based on pressing to form a pair of substantially parallel side wall sections and a connection section for connecting the widthwise edges of the both side wall sections and to form at least one pair of circular holes in the both side wall sections at locations in alignment, of deforming the middle of the connection section in the thickness direction to form an engagement portion on one side of the connection section such that the engagement portion is recessed from the other portion of the connection section, and of forming on the other side of the connection section a bulge section, trapezoidal in cross section, which protrudes in an embanked-shape as the engagement portion is formed, whereby the widthwise edges of the middle of the bulge section corresponding to the top edge of the trapezoidal shape exist on the widthwise inside of the both widthwise edges of the engagement portion.

8 Claims, 16 Drawing Sheets

METAL PLATE ROCKER ARM AND METHOD OF MANUFACTURING THE METAL PLATE ROCKER ARM

FIELD OF THE INVENTION

This invention relates to a rocker arm that is installed in the valve mechanism of an engine for transforming the rotation of the camshaft to reciprocating motion of the valve unit (intake valve and exhaust valve), and more particularly to improvement of a rocker arm made of sheet-metal by pressing process.

BACKGROUND OF THE INVENTION

In reciprocating engines (reciprocating piston engines), except for some 2-cycle engines, there is an intake valve and an exhaust valve that open and close in synchronization with the rotation of the crankshaft. In this kind of reciprocating engine the movement of the cam shaft, which rotates in synchronization with the rotation of the aforementioned crankshaft (at ½ the rpm in the case of a 4-cycle engine), is transmitted to the aforementioned intake valve and exhaust valve through the rocker arm, to cause the intake valve and exhaust valve to move back-and-forth in the axial direction.

Conventionally, it has been typical for the rocker arm installed in the valve mechanism of this kind of engine to be a molding (cast iron or aluminum die cast article). However, moldings are heavy (in the case of cast iron) or have a large volume in order to maintain sufficient strength (in the case of cast aluminum parts). Moreover, since in most cases the moldings are made using a lost wax process, it is difficult to avoid high manufacturing cost. Therefore, recently, manufacture the aforementioned rocker arm by pressing a sheet metal such as steel sheet has been considered and has been performed in some cases.

The manufacturing method of a this kind of rocker arm made of sheet metal has been disclosed previously, for example as disclosed in Japanese Patent Publication No. Tokukai Hei 3-172506. In the manufacturing method described in this publication, the sheet metal rocker arm is manufactured in one piece by pressing a single sheet of sheet metal. Therefore, the sheet metal rocker arm that is obtained has a nearly uniform thickness over its entire surface.

In contrast to this, a rocker arm that is manufactured by joining or welding two or three members together that are each formed by pressing sheet metal has been known. With this construction, the thickness of each of these members is the same, however, in the case of a rocker arm that is formed by combining a plurality of members in this way, the thickness of the connection section, including the pivot section and the valve engagement, can be made larger than the wall sections.

Of the prior art described above, in the case of Japanese Patent Publication No. Tokukai Hei 3-172506 where the sheet-metal rocker arm is made from one sheet of metal, the thickness of the sheet metal rocker arm is nearly uniform over the entire surface, so the area around the valve engagement that receives strong forces during use, has a large strength disadvantage compared with other parts and rigidity may also become low. When the thickness of the metal sheet used for making the sheet metal rocker arm is increased in order to sufficiently secure the strength and rigidity of the area near the valve engagement, the thickness of the other parts becomes greater than necessary, making it impossible to sufficiently make the sheet-metal rocker arm compact and lightweight, and also increases the cost of material.

On the other hand, in the case of a sheet-metal rocker arm that is made by welding together two or three members that are formed by pressing sheet metal, the thickness of the connection section, including the valve engagement, can be made thicker than other parts, such as the wall sections, however, after the members have been individually made, they must be combined and joined together by welding. Therefore, the number of processing steps increases, and managing the parts can be troublesome. Furthermore, complicated, precision equipment is necessary for positioning the parts when putting them together, so in addition to the increase in the number of processing steps and the need for managing the parts, it is impossible to avoid increased manufacturing cost. Moreover, the quality (precision) of the sheet-metal rocker arm is inferior when compared with a rocker arm made in one piece.

In order to solve the problems mentioned above, an invention was disclosed in Japanese Patent Publication No. Tokukai Hei 11-63515, as shown in FIGS. 1 thru 7, relating to sheet-metal rocker arm and the manufacturing method thereof. As shown in FIG. 1, the sheet-metal rocker arm of this previous invention comprises a pair of wall sections 2 that are nearly parallel with each other, and a first connection section 3 and second connection section 4 that connect one of the edges in the width direction of both of the wall sections 2 together, respectively. Moreover, a pair of concentric circular holes 5 is formed in the middle in the lengthwise direction of both of these wall sections 2, and both ends of a support shaft for supporting the roller that interacts with the cam are supported in these holes 5 such that the roller rotates freely. Of the first connection section 3 and the second connection section 4, an engagement section 6 is formed on one surface of the first connection section 3 for coming into contact with the base of the valve unit, and a second engagement section 7 is formed on the second connection section 4 for coming into contact with the tip end of a rush adjuster.

Of the first engagement section 6 and the second engagement section 7, the first engagement section 6 is formed on its one surface into a concave channel shape by plastic deformation in the thickness direction in the middle in the width direction of the first connection section 3 such that it is depressed more than the other parts of the first connection section 3. Also, there is a raised section 8 on the other surface of the first connection section 3, having a trapezoidal cross-section that is protruded outward in a banked shape as the first engagement section 6 is formed. On the other hand, the second connection section 7 is formed into a spherical concave shape by plastic deformation in the thickness direction in the center of the second connection section 4.

When making the sheet-metal rocker arm as described above, first, in a first process, a first blank 9 is made as shown in FIG. 2. In other words, in this first process, a metal sheet (flat sheet or coiled sheet) such as a carbon steel sheet with a thickness of 3 to 4 mm and having sufficient rigidity is supplied between the punching die and cradle die of a press apparatus (not shown in the figure), and the first blank 9 is punch-pressed and formed between these two dies.

As shown in FIG. 2(A), this first blank 9 has a nearly diamond shape with rounded corners and with one end in the lengthwise direction (right end in FIG. 2(A)) cut off, and has a thickness $t_9$ (FIG. 2(B)). In the center in the width direction (up and down directions in FIG. 2(A)) of this first blank 9, in the section slightly inside of the two dot-dashed lines $\alpha$ shown in FIG. 2(A) (the center in the width direction), the portion with width $W_{10}$ is a base section 10 that is continuous in lengthwise direction (left and right directions in FIG.

2(A)) of the first blank 9. On both sides in the width direction of this base section 10 there is a pair of nearly triangular wing-shaped sections 11.

Next, in a second process, a through hole 12 is formed in the center of the first blank 9 as shown in FIG. 3(A), to become the second blank 13. The shape of this through hole 12 is formed in nearly an hourglass shape with the center section in the lengthwise direction of both edges in the width direction formed with a pair of tongue-shaped sections 14 in a partial arc shape protruding toward each other. These two tongue-shaped sections 14 are provided for forming circular holes 5 (see FIG. 1 and FIG. 7) for supporting both ends of a support shaft for supporting a roller, to be described later, such that it rotates freely. In addition, semi-circular cutout sections 15 are formed in each of the four corners of the through hole 12. These cutout sections 15 are provided for making it easier in the third process to bend the base section 10 in an arc shape in cross section to form a curved section 16 (see FIG. 4).

This second blank 13 described above is formed by supplying the first blank 9 between the punching die and cradle die of a press apparatus (not shown) and punching out the through hole 12 between these two dies. The width $W_{10}$ of the base section 10 of the first blank 9 and second blank 13 is wider than the width $W_{17}$ ($W_{10}>W_{17}$) of a first intermediate blank 17 (see FIG. 4) which is the distance between the outer sides of a pair of wall sections 2 that are formed ill the third process described next. As the width $W_{10}$ of the base section 10 is made wider than the width $W_{17}$ of first intermediate blank 17, the distance $D_{14}$ between the pair of tongue-shaped sections 14 is also made large.

When the distance $D_{14}$ between the pair of tongue-shaped sections 14 is made large in this way, it is possible to secure the life of the punching die used for punching out the aforementioned through hole 12. In other words, when the width of the center section of the through hole 12 is narrow, the load on the punching die used for punching out this through hole is large, which shortens the life of the punching die. On the other hand, when the width of the center section of the through hole 12, that is the distance $D_{14}$ between the pair of tongue-shaped sections 14, is large, the load on the punching die used for forming the through hole 12 is decreased, making it possible to secure the durability of the punching die, and thus making it possible to reduce costs.

As to the order of forming the second blank 13, it is also possible to first, form the through hole 12 instead of by the second process described above, then to form the base section 10 and wing-shaped section 11 instead of by the first process. Furthermore, if the capacity of the press apparatus is sufficient and the punching die and cradle die are capable, it is possible to directly form the second blank 13, as shown in FIG. 3, from the sheet metal material.

In either case, the second blank 13 that is formed in the shape shown in FIG. 3 is then formed into the first intermediate blank 17, as shown in FIG. 4, by the following third process. In the third process, the second blank 13 is supplied between the pressing die and cradle die of a press apparatus (not shown in the figure), and strongly pressed to bend the base section 10 and wing-shaped sections 11 of the second blank 13. This second blank 13 is formed into a first intermediate blank 17, having a pair of wall sections 2 on the left and right in the width direction, and a curved section 16 for connecting the edges in the width direction (left and right directions in FIGS. 4(C) and 4(D)) of these wall sections 2. This curved section 16 is formed in a semi-cylindrical shape such that it is discontinuous in a portion that corresponds to the through hole 12 in the center in the lengthwise direction (left and right directions in FIG. 4(A)) of the first intermediate blank 17. Of the curved section 16 that is divided into two by the through hole 12 in this way, the portion on one end side (right end side in FIG. 4(A)) becomes the engagement section 6 that comes in contact with the base of the valve knit, and the portion on other end side (left end side in FIGS. 4(A) and 4(B)) becomes the second engagement section 7 (see FIG. 1, FIG. 6 and FIG. 7) that comes in contact with the tip end of a rush adjuster.

As described above, the width $W_{17}$ of the first intermediate blank 17, which is the distance between the outside surfaces of the pair of wall sections 2, is smaller than the width $W_{10}$ of the base section 10 of the first and second blanks 9 and 13. In other words, the curved section 16 in the first intermediate blank 17, which acts as the connection section for connecting the edges in the width direction of the pair of wall sections 2, is formed in a semi-cylindrical shape as shown in FIGS. 4(C) and 4(D). Since the width of this semi-cylindrical curved section 16 is less than the width $W_{10}$ of the flat base section 10 which is to be formed into the semi-cylindrical carved section 16, it is possible to make the width $W_{10}$ of this base section 10 larger than the width $W_{17}$ of the first intermediate blank 17, that is the distance between the pair of left and right wall sections 2, 2 ($W_{10}>W_{17}$), and thus it is possible to make the distance $D_{14}$ between the pair of tongue-shaped sections 14 large. The thickness $t_{16}$ of the curved section 16 of the first intermediate blank 17 shown in FIG. 4, which is obtained from the third process described above, is nearly the same as the thickness $t_9$ of the first blank 9 ($t_{16}\approx_9$).

Next, in a fourth process, pressing is performed for at least one end of the curved section 16 that forms the engagement section 6 that comes in contact with the base end of the valve unit, in order to increase the thickness. In this case, in order to obtain the desired thickness after the pressing process, it is necessary to regulate the shape and dimensions of the curved section 16. In other words, selecting the size and dimensions of the curved section 16 determines the aforementioned thickness in the pressing process. Moreover, at the same time that the curved section 16 is formed on the first intermediate blank 17, the pair of left and right wall side sections 2 is also formed. In other words, as the curved section 16 is formed, the wing-shaped sections 11, which are formed on both ends in the width direction of the first and second blanks 9 and 13, and the tongue-shaped sections 14, which are formed on the inner edges in the through-hole 12 in the center of the second blank 13, are raised upright such that they become the pair of nearly parallel side wall sections 2.

In the fourth process, the curved section 16 of the first intermediate blank 17, which is formed as described above, is pressed to form the second intermediate blank 18 as shown in FIG. 5. In other words, in the fourth process, the curved section 16 is flattened and its thickness is increased to form a connection section 3 and second connection 4 having thick nesses $t_3$ and $t_4$, which are greater than the thickness $t_9$ (see FIG. 2B) of the first blank ($t_9<t_3$, $t_4$). The curved section 16 does not need to be a semi-circular cylindrical shape, but can be curved in a semi-oval or semi-elliptical cylindrical shape etc.

The fourth process mentioned above is performed by setting the curved section 16 of the first intermediate blank 17 between a pressing die for pressing and a cradle die and performing cold forging by pressing to plastically deform the curved section 16. As a result, a flat connection section 3 and second connection 4 are formed. When plastically deforming the curved section 16 to form the connection section 3 and second connection section 4, as the curved section 16 with arc-shaped cross-section is deformed to become the flat connection section 3 and second connection section 4, they are thickened to the thickness $t_3$ and $t_4$. In this way, the process where the thickness is increased at the same time as the curved section 16 with arc-shaped cross-section is deformed to become the flat connection section 3 and second connection section 4, can be easily performed by pressing with a press.

In the example shown in the figures, the thickness of connection section 3 formed on one side is increased as well as the thickness of the second connection section 4 that is formed on the other side is increased. However, when the sheet-metal rocker arm is in operation, an especially large stress is applied to the connection section 3 provided with the engagement section 6 that comes in contact with the base end of the valve unit. Therefore, the thickness of the second connection section 4 on the other side must not necessarily increased. When it is not necessary to increase the thickness, the curved section 16 can be plastically deformed to simply form a flat connection section. However, by making the thickness of the connection section 3 and second connection section 4 the same less processing is required, which is advantageous from the aspect of cost.

In the fourth process, when the connection section 3 and second connection section 4 with a relatively large thickness are formed in the first intermediate blank 17 to make a second intermediate blank 18, then in the fifth process a plastic deformation process or cutting process, and when necessary a grinding process, is performed for the connection section 3 and second connection section 4. In other words, as shown in FIG. 6, the engagement section 6, which comes in contact with the base end of the valve unit (not shown in the figure), is formed on the connection section 3. Moreover, the second engagement section 7, which comes in contact with the tip end of a rush adjuster, is formed on the second connection section 4. In this fifth process, the connection section 3 of the second intermediate blank 18 is set between the pressing die and cradle die of a forging apparatus to perform cold forging of the connection section 3 to form a concave engagement section 6 with a bottom surface that is curved in a convex shape as shown in FIGS. 6(A), 6(B) and 6(D). Moreover, the second connection section 4 is set between the pressing die and cradle die of a different forging apparatus (not shown in the figure) to perform cold forging of this second connection section 4 to form a spherical concave hole or second engagement section 7, as shown in FIG. 6(A), 6(B) and 6(C). From this fifth process, an engagement section 6 and second engagement section 7 are formed on the respective connection section 3 and second connection section 4, which have thicknesses that are greater than the thickness of the first blank 9, to form the third intermediate blank 19. The order of the processes from the first to fifth can be changed. For example, it is possible to change the order of the processes above or the shape of the intermediate blanks such that they are suitable for transfer-press processing or progressive processing. However, in the end, the third intermediate blank 19 should be obtained.

The third intermediate blank 19 that is obtained in this way is processed in the sixth process by pressing or drilling to form circular holes 5 at matching positions in the middle of the pair of side wall sections 2 to form the completed sheet-metal rocker arm 1 as shown in FIG. 1 and FIG. 7. As described above, both of these circular holes 5 are provided for supporting both of the ends of a support shaft that rotatably supports the roller. In other words, the roller is supported in the middle of the support shaft whose ends are supported in the aforementioned circular holes 5 such that the roller rotates freely, and the outer peripheral surface of the roller comes in contact with the outer peripheral surface of the cam to transform the rotating motion of the cam shaft to rocking motion of the sheet-metal rocker arm 1.

The sheet-metal rocker arm and the manufacturing method for it of the previous invention described above, not only makes it possible to improve the strength and rigidity of the rocker arm, but by reducing the number of processes and parts, also make it possible to reduce cost, improve precision and simplify the equipment used.

However, in order for it to obtain more strength so as to be possible to install the rocker arm in an engine with large output, improvements of the following aspect related to the engagement section 6 that comes in contact with the base of the valve unit are desired. In this case, it is difficult, with the manufacturing method for the sheet-metal rocker arm of the previous invention described above, to improve this aspect.

This aspect will be explained using FIG. 8, which shows the cross-section shape of the engagement section 6 that is formed on the sheet-metal rocker arm 1 of the previous invention described above. By deforming the middle of the connection section 3 in the thickness direction, the aforementioned engagement section 6 is formed such that one surface (bottom surface in FIG. 8) of the connection section 3 is more concave than other sections of the connection section 3, and there is a bulge section 8 with a trapezoidal-shaped cross-section that protrudes in the shape of an embankment on the other surface (top surface in FIG. 8) of the connection section 3. In the case of the conventional construction, the width $W_{20}$ of the center of this bulge section 8, which corresponds to the top of the trapezoidal shape in cross section of this bulge section 8, was the same as or greater than the width $W_6$ of the aforementioned engagement section 6 ($W_{20} \geqq W_6$). In addition, both edges in the width direction (left and right direction in FIG. 8) of the center section 20 are in nearly the same position as or outside of in the width direction of both edges in the width direction of the engagement section 6.

The aforementioned engagement section 6 and bulge section 8 are formed by pressing tightly a portion, corresponding to the connection section 3 on the end of the second intermediate blank 18, in the fifth process, between the pressing die and cradle die of a press apparatus. At that time, when the width $W_{20}$ of the center section 20 of the bulge section 8 is the same as or greater than the width $W_6$ of the engagement section 6, a shear force is applied to part in the width direction of the connection section 3 at both ends in the width direction of the engagement section 6 (section shown by the dot-dash line β in FIG. 8). As a result, internal distortion occurs in this section, and not only does it become easy for cracking or the like to occur during manufacture, but there is also a possibility that damage such as cracking could occur at both ends in the width direction of the engagement section 6.

The force applied to the engagement section 6 during operation becomes large as the spring force of the return spring to energize the valve unit whose base section comes in contact with the engagement section 6 is made large in order that the output of the engine becomes large. Also, in order to be able to install the sheet-metal rocker arm in a high-output engine and to secure sufficient durability, it is desired that the strength of the engagement sections 6 be increased.

In order to accomplish that, it is also desired that the thickness of the engagement section 6 be increased, however in the manufacturing method of the previous invention described above, the amount that the thickness can be increased is limited to about 5 to 40% of the thickness of the raw sheet. For example, it is difficult to increase the thickness $t_3$ of the connection section 3 of the engagement section 6 to nearly two times or more than two times the thickness t, of the pair of side wall sections 2.

In consideration of the problems described above, an objective of this invention is to provide a sheet-metal rocker arm and manufacturing method that solves these problems.

BRIEF DESCRIPTIONS OF THE INVENTION

DISCLOSURE OF THE INVENTION

Figure 1:
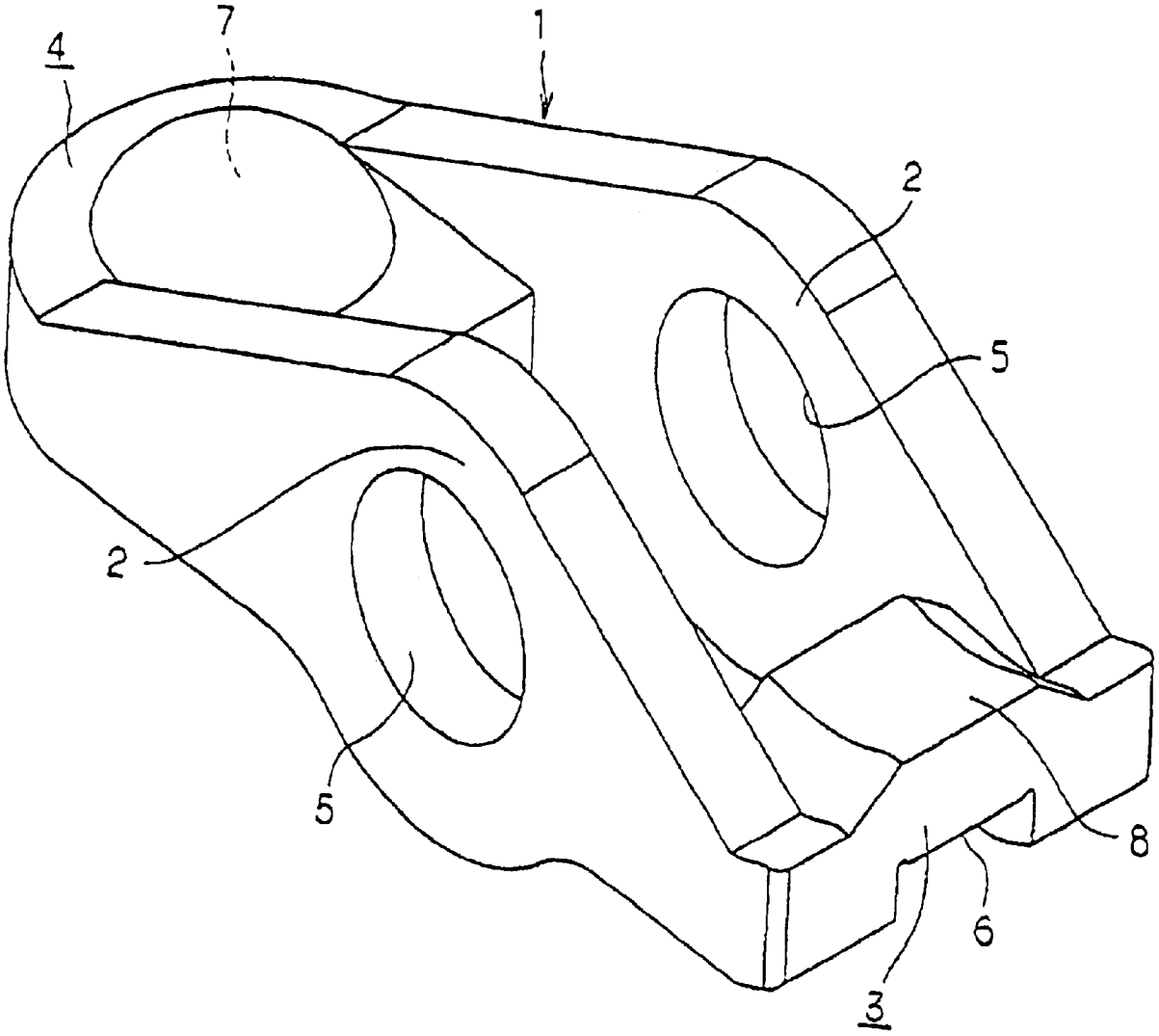
FIG. 1 is a perspective view of a sheet-metal rocker arm according to the previous invention.

The sheet-metal rocker arm 1 of this invention is formed by punching one sheet of metal member to form a blank having a specified shape and through holes, and by performing a bending process for this blank based on a press process, such that a pair of nearly parallel side wall sections and a connection section that connects the edges in the width direction of both of these side wall sections are formed, and that at least one pair of circular holes are formed at corresponding locations in alignment in both side wall sections, and then by deforming in the thickness direction the middle of the connection section, so that an engagement section is formed on one surface of the connection section that is more concave than the other surface of the connection section. Moreover, as this engagement section is formed, a protrusion protrudes in an embanked shape from the other surface of the connection section to form a bulge section having a trapezoidal cross-section. The construction described above is the same as for the sheet-metal rocker arm of the previous invention as mentioned above.

Furthermore, in the case of the sheet-metal rocker arm of this invention, both edges in the width direction of the center section of this bulge section, which corresponds to the top of the aforementioned trapezoid, are located inside in the width direction than both edges of the engagement section.

It is preferred to make the thickness of the engagement section greater than the thickness of both side wall sections by increasing the thickness of the connection section from which the engagement section is formed.

It is further preferred that, of the thicknesses of the connection section, the ratio t/T of the thickness t of the thinnest section, or the distance between the inclined section on both sides in the width direction of the bulge section and the corner sections of the engagement section, with respect to the thickness T of the thickest section, or the distance between the center of the bulge section and the engagement section, be 0.5 or greater.

Similar to the sheet-metal rocker arm of the previous invention as mentioned above, the sheet-metal rocker arm of this invention, as described above, is formed in a single body from a single sheet of sheet metal, so that there is no need for joining a plurality of members that have been made separately, and it is possible to reduce the number of processes, while at the same time it is possible to prevent increasing manufacturing costs and worsening precision, and do away with the need for complicated equipment for assembly and positioning, and it is possible to produce a high quality sheet-metal rocker arm at a lower cost.

Particularly, in the case of the sheet-metal rocker arm of this invention, a bulge section provided on the side opposite to the engagement section in the thickness direction of the connection section, and both edges in the width direction of the center of the bulge section, which corresponds to the top of the trapezoid in cross section of the bulge section, are further inside in the width direction than both sides in the width direction of the engagement section, so that when forming the engagement section and bulge section, no shear force is applied to any part of the connection section. Therefore, it is possible to make it more difficult for damage due to cracking or the like to occur in the connection section.

Moreover, when the thickness of the connection section provided with the engagement section is made to be greater than the thickness of both of the side wall sections, the work of increasing the thickness of this connection section can be performed by just a pressing process without the need for special equipment, so that it is possible to keep down the investment in equipment, and by saving energy by automated processing, it is possible to manufacture a high-quality sheet-metal rocker arm at low cost. In addition, regardless of whether or not the sheet-metal rocker arm is formed from one sheet of metal of uniform thickness, it is possible to make the thickness of the connection section, which includes the engagement section, greater than the thickness of the pair of side wall sections. It is also possible to reduce the stress forces that act on the sheet-metal rocker arm and maintain the strength and rigidity of the sheet-metal rocker arm without unnecessary weight increase. The thickness of both of the side wall sections can be such that it is possible to maintain the strength and rigidity that are required for both of the side wall sections, and does not need to be any greater than necessary. Also, it is possible to reduce the width of the sheet-metal rocker arm, which is the distance between the outside surfaces of both of the wall sections. This makes it easier to design the sheet-metal rocker arms, so that it can be assembled in the limited space inside the engine.

Furthermore, when the ratio t/T of the thickness t of the thinnest part of the connection section and the thickness T of the thickest part, which is the distance between the center of the bulge section and the engagement section, is 0.5 or greater, the force applied to the connection section during use of the sheet-metal rocker arm becomes uniform, making it possible to even more effectively prevent damage to the connection section.

Also, with the method for manufacturing a sheet-metal rocker arm of this invention, the sheet-metal rocker arm is manufactured such that a blank having a specified shape and through holes is formed by punching one sheet of metal, that a bending process is applied to the blank by a press ing process so as to form a pair of nearly parallel side wall sections and a connection section that connects the edges in the width direction of those side wall sections, that at least one pair of through holes are formed at locations in alignment in both of the side wall sections, and that at least one engagement section is formed on part of the connection section. In addition, the thickness of the connection section where the engagement section is formed is greater than the thickness of both of the side wall sections.

With the manufacturing method of this invention for manufacturing a sheet-metal rocker arm, the thickness of the engagement section is increased by pressing the protruding section, which protrudes from the ends that are next to the part of the blank that becomes the engagement section, in both directions of the blank toward the part that becomes the engagement section. After the thickness of this has been increased, there is a process for forming th is section into the engagement section. Both directions mentioned here are the directions parallel to the front and rear surfaces of the blank.

Preferably, one metal material such as sheet metal is fed from an uncoiler or the like and punched by performing a sequential punching process in synchronization with the feeding of this metal material, so that a continuous section is formed such that it is located in the center in the width direction of this metal material, and a pair of blanks are formed such that they extend outward in opposite directions from both edges in the width direction of this continuous section at the portion where the phase in the length direction of each side matches each other. A protruding section is provided on the opposite sides of these blanks in pair, respectively. Then by pressing both of the protruding sections in a direction toward each other, the thickness of part of these blanks is increased. Also, in any of the processes after this process, these blanks are cut and removed from the continuous section.

Also, preferably, after increasing the thickness of part of the blank that will become the engagement section, it is annealed in an annealing process and then a through hole is formed in the center of this blank, then the blank is bent at two locations with the through hole therebetween in the same direction to form a pair of side wall sections.

Moreover, preferably, after the thickness of the part of the blank that will become the engagement section has been increased, the through hole in the center of this blank is formed such that its width is nearly the same as that of the increased-thickness part, and such that the phase in the width direction of the blank corresponds with that of the section with the increased-thickness part. Then, at two locations on the blank in between which the through hole is located, that is along the section where the thickness was increased and along the section that nearly corresponds to both edges in the width direction of the through hole, the blank is bent in the same direction to form a pair of side wall sections. The places of the blank that are bent when forming the side wall sections are located along the section where the thickness was increased and along the section that nearly corresponds to both edges in the width direction of the through hole.

Furthermore, preferably, after the sheet-metal rocker arm is processed to its final form, heat treatment, such as carbonization heat treatment, is performed for hardening the surfaces of the sheet-metal rocker arm, and then processing is performed to remove to the intergranular oxidation layer from the surface of the sheet-metal rocker arm. It is preferred that the process for removing this intergranular oxidation layer be a method of striking the surface of the sheet-metal rocker arm with particle matter like media, such as in shot blast or barrel processing.

Particularly, in the case of the sheet-metal rocker arm of this invention, it is possible to make the thickness of the connection section where the engagement section is formed much thicker than the thickness of both side wall sections. Therefore, in spite of the fact that the sheet-metal rocker arm is formed from one blank with uniform thickness, it is possible to make the thickness of the connection section, including the engagement section, much thicker than the thickness of the pair of side wall sections. Accordingly, it is possible to greatly reduce the stress that is applied to the connection section, including the engagement section, and to secure the strength and rigidity of the sheet-metal rocker arm without having to unnecessarily increase the weight. Also, the thickness of both of the side wall sections can be such that it is possible to secure the strength and rigidity that are required for both of the side wall sections, and does not need to be any greater than necessary. Accordingly, it is possible to reduce the width of the sheet-metal rocker arm, which is the distance between the outside surfaces of both of the side wall sections. This makes it easier to design the sheet-metal rocker arms so that it can be assembled in limited space inside the engine.

Also, by providing a pair of blanks connected to each other by a continuous section, and having a protruding section which protrude from the opposing sides of the blanks and by pressing the protruding sections in a direction toward each other, to partly increase the thickness of each blank, it is possible to cancel the force applied to both blanks during this pressing process. Therefore, it is possible to reduce the rigidity of the portion that receives the force applied during this pressing process, and thus it is possible to simplify and reduce the cost equipment used.

Also, when annealing of the blank is performed before bending part of the blank to form the pair of side wall sections, it is possible to soften the portion that was hardened by work-hardening during the pressing process, and remove any residual stresses. Therefore, it not only becomes easier to perform the work of forming the side wall sections, but it is also possible to effectively prevent damage due to cracking from occurring in the bent sections.

Also, by matching the portion of the blank having the increased thickness, which will become the engagement section, with the through hole in the width and phase in the width direction, and by making the position of the bending when forming the side wall sections nearly match with the both ends in the width direction of the through hole, it is not only possible to easily perform the work of forming the side wall sections, but it is also possible to effectively prevent damage due to cracking from occurring in the bent sections.

Furthermore, by performing a process for removing the intergranular oxidation layer from the surface of the sheet-metal rocker arm after performing heat treatment for hardening the surface of the sheet-metal, it is possible to remove minute grooves that cause damage such as cracking, and improve the durability of the sheet-metal rocker arm. In this case, by performing the process for removing this intergranular oxidation layer by a method of striking the surface of the sheet-metal rocker arm with particle matter like media, such as in shot blast or barrel processing, it is possible to produce residual compression stress in the surface layer portion of the sheet-metal rocker arm and to more effectively prevent the occurrence of damage due to cracking.

Best Embodiments to Work the Invention

Figure 9:
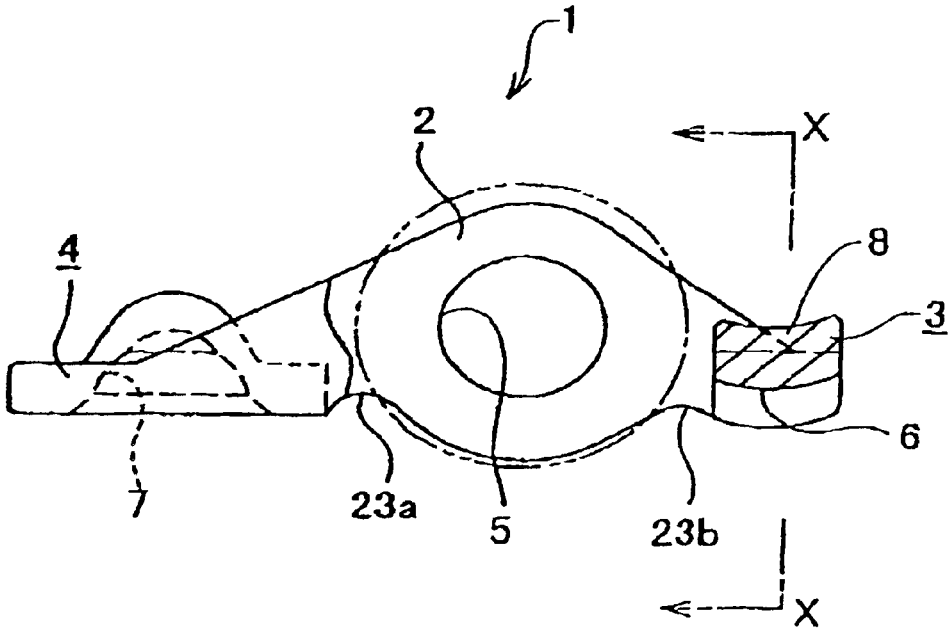
FIG. 9 is a partially cross sectional, side view to show a first example of the embodiment of the present invention.
Figure 10:
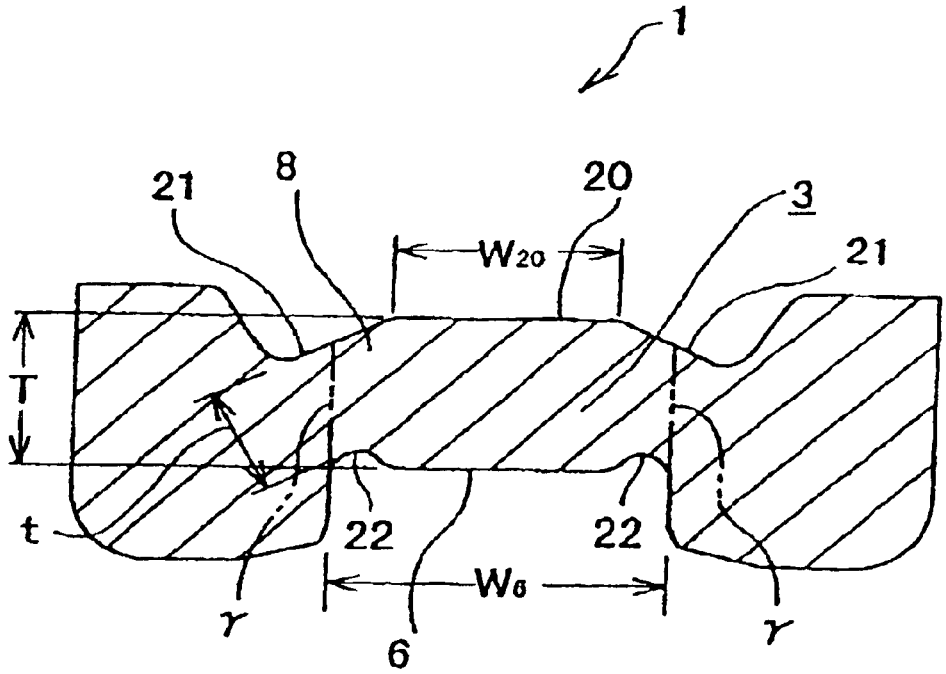
FIG. 10 is an enlarged cross sectional view taken along the line X—X in FIG. 9.

FIGS. 9 and 10 show a first example of the embodiment of the sheet-metal rocker arm of this invention. This invention is characterized by the cross-sectional shape of the aforementioned connection section 3 for sufficiently maintaining the durability of the connection section 3 and imp roving the strength of the engagement section 6, even when the elastic force of the return spring that energizes the valve unit whose base end is in contact with the engagement section 6 that is formed on one surface bottom surface in FIGS. 9 and 10) of the connection section 3 is large, and therefore when the force applied to the engagement section 6 is large, the construction of the other parts of the sheet-metal rocker arm 1 are the same as in the aforementioned previous invention, so the same numbers will be given to identical parts, and any redundant explanation will be omitted or simplified. This explanation will center on the characteristics of this invention.

First, the construction, function and effect of one feature of the invention will be explained. As in the ase of the aforementioned previous invention, the engagement section 6 is formed by deforming the center section in the width direction of the connection section 3 (front and rear direction in FIG. 9, and left and right direction in FIG. 10) in the thickness direction (up and down direction in FIGS. 9 and 10). As this engagement section 6 is formed on the one surface (lower surface in FIGS. 9 and 10) of the connection section 3 such that it is more concave than the other parts of the connection section 3, the other surface (upper surface in FIGS. 9 and 10) of the connection 3 protrudes in a banked shape to form a bulge section 8 with a trapezoidal cross section. The cross-sectional shape of this bulge section 8 in the width direction (front and rear direction in FIG. 9, and left and right direction in FIG. 10) of the sheet-metal rocker arm 1 is a trapezoid shape. Also, on both sides of the center section 20 of the bulge section 8, which corresponds to the top of the trapezoid, a pair of inclined sections 21 are formed such that they are inclined toward the engagement section 6 in a direction away from the center section 20.

Figure 2:
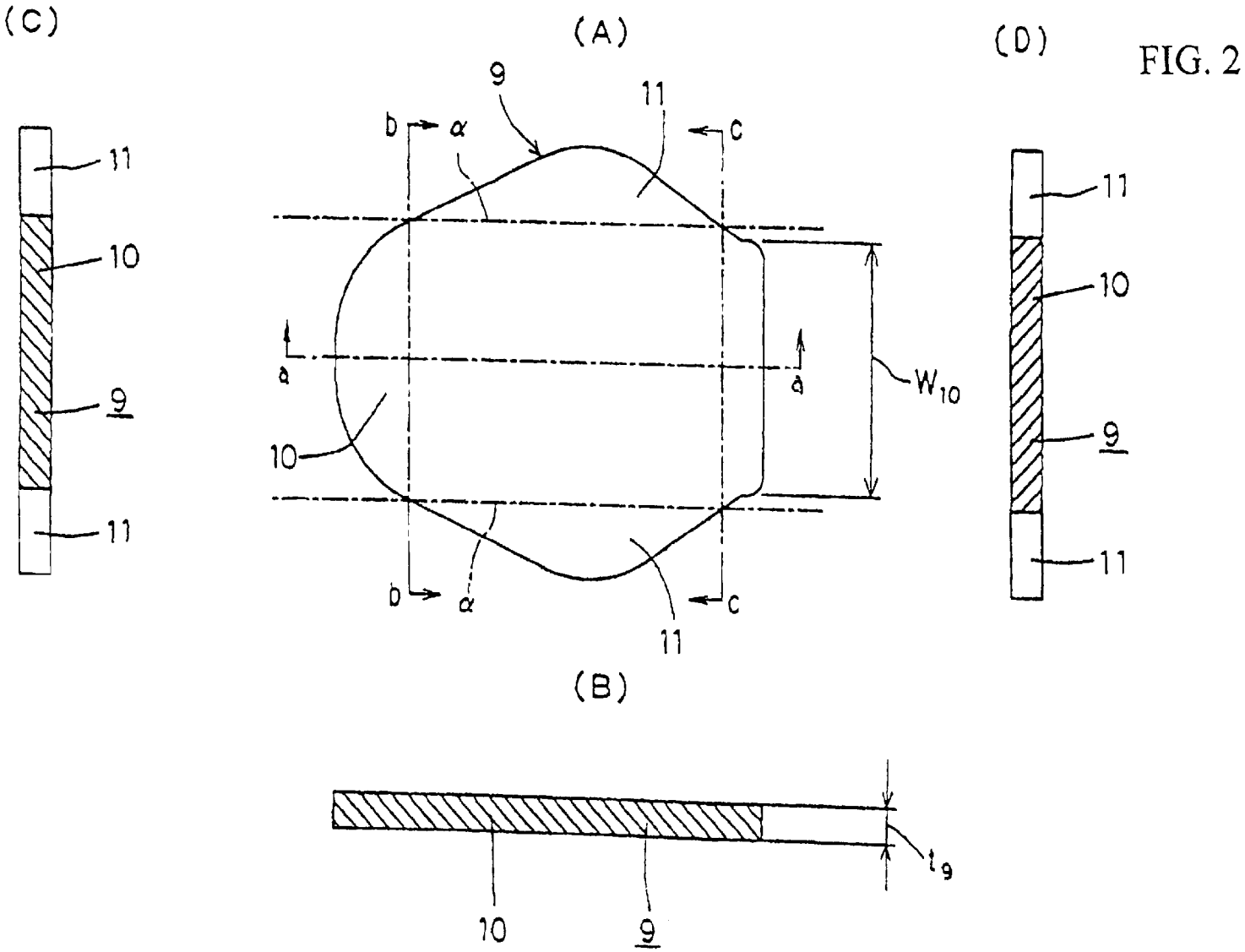
FIG. 2 is to show a first blank sheet obtained by the first step of the previous invention, wherein (A) is a plan view, (B) is a cross sectional view taken along the line a—a in the (A), (C) is a cross sectional view taken along the line b—b in the (A), and (D) is a cross sectional view taken along the line c—c in the (A).

Particularly, in the case of the sheet-metal rocker arm of this invention, the width $W_{20}$ of the center section 20 is less than the width $W_6$ of the engagement section 6 ($W_{20}<W_6$). Also, both ends in the width direction (left and right direction in FIG. 2) of the center section 20 are located further inside in the width direction than both ends in the width direction of the engagement section 6. Therefore, in the example shown in the figures, the center position in the width direction of the center section 20 matches with the center position in the width direction of the engagement section 6 (in alignment in the phase in the width direction matches). The amount that the width $W_{20}$ of the center section 20 is less than the width $W_6$ of the engagement section 6 is regulated within a range such that shear forces do not occur inside the connection section 3 when pressing the engagement section 6. Accordingly, the width $W_{20}$ of the center section 20 is 80% or less than the width $W_6$ of the engagement section 6 ($W_{20}\leqq 0.8\ W_6$), and even more preferable, 60% or less ($W_{20}\leqq 0.6\ W_6$).

Figure 5:
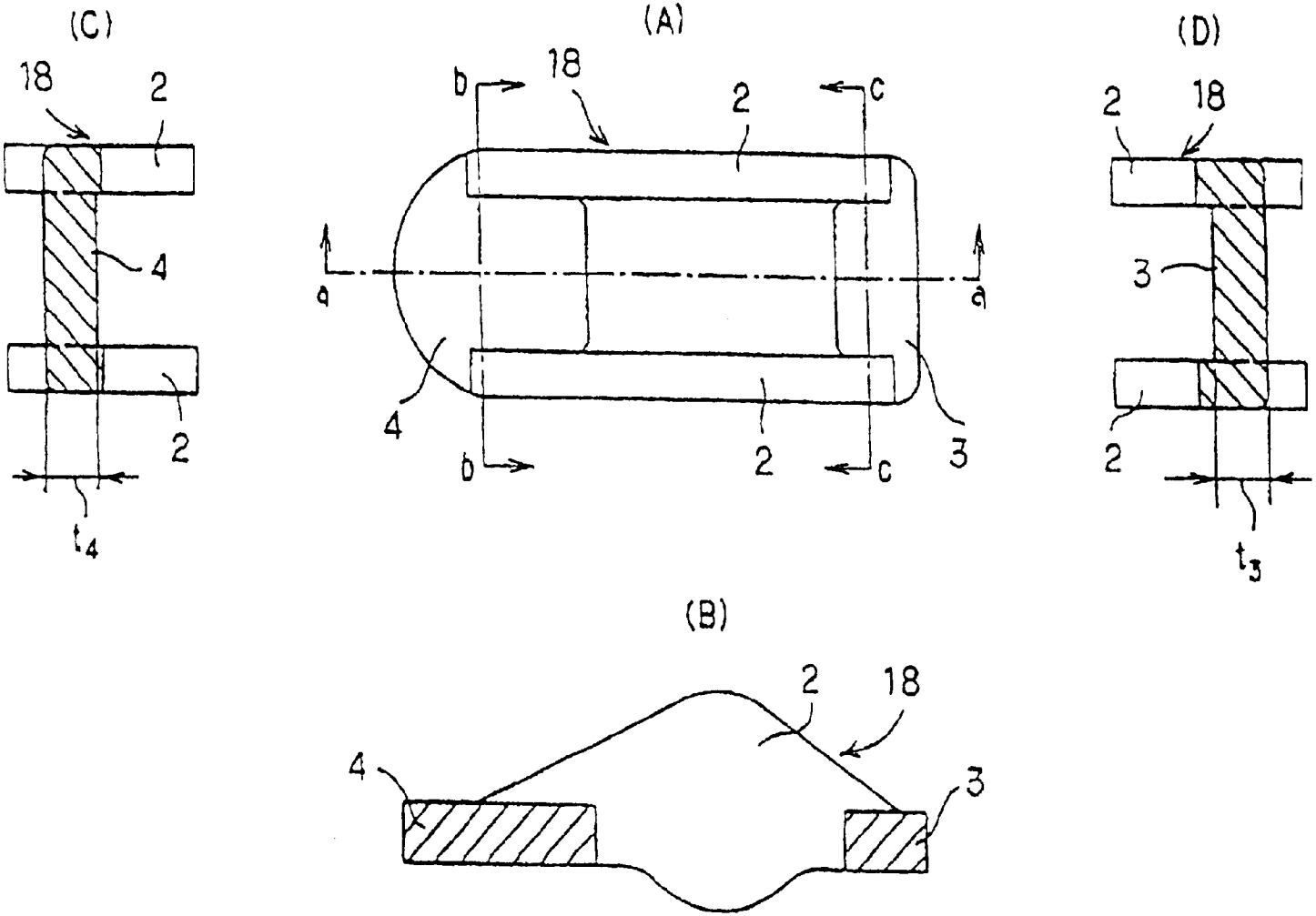
FIG. 5 is to show a second blank sheet obtained by the second step of the second step of the previous invention, wherein (A) is a plan view, (B) is a cross sectional view taken along the line a—a in the (A), (C) is a cross sectional view taken along the line b—b in the (A), and (D) is a cross sectional view taken along the line c—c in the (A).
Figure 6:
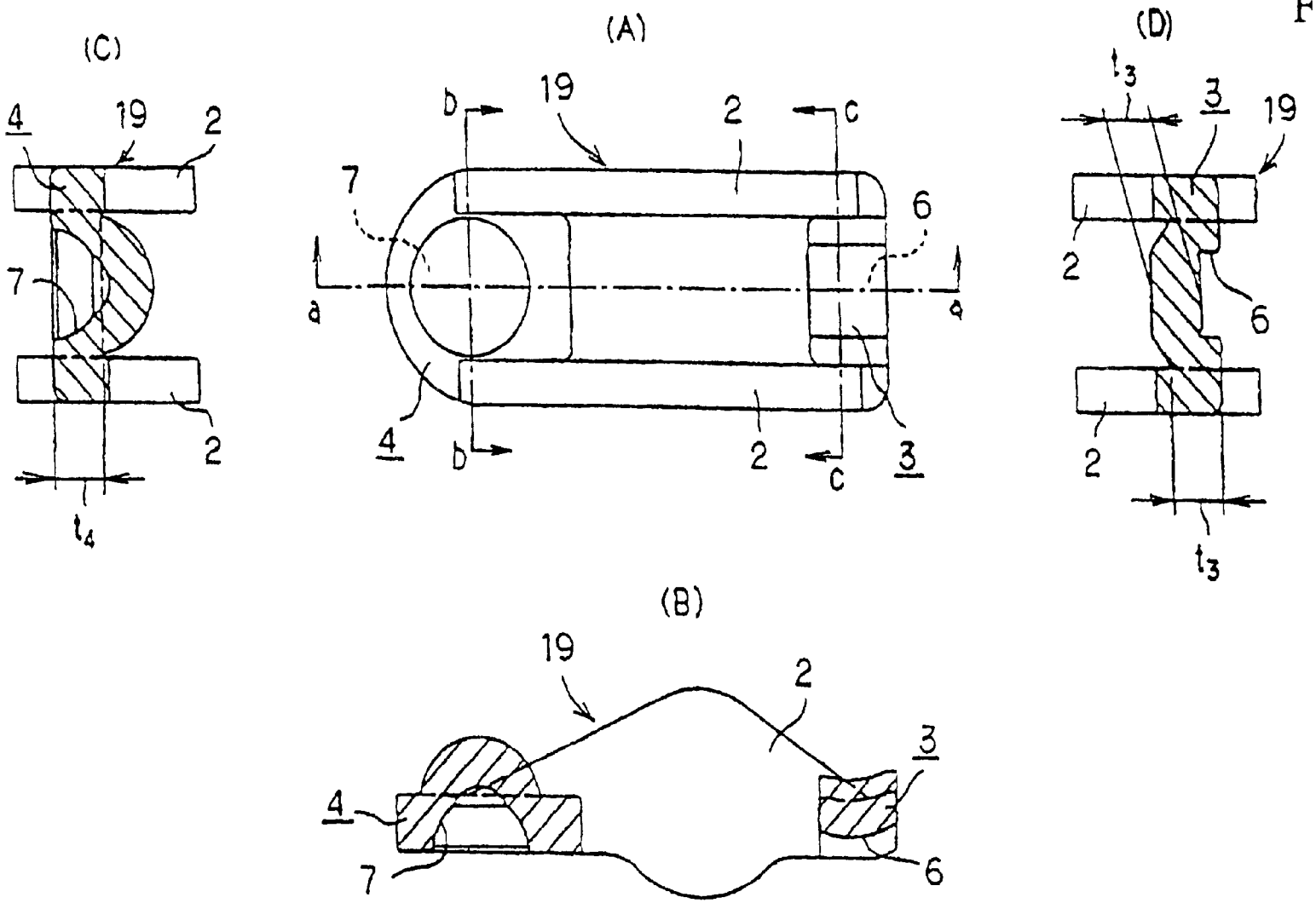
FIG. 6 is to show a second blank sheet obtained by the second step of the second step of the previous invention, wherein (A) is a plan view, (B) is a cross sectional view taken along the line a—a in the (A), (C) is a cross sectional view taken along the line b—b in the (A), and (D) is a cross sectional view taken along the line c—c in the (A).

The engagement section 6 and bulge section 8 are form ed by strongly pressing the part corresponding to the connection section 3 on the end of the second intermediate blank 18 (see FIG. 5) between the pressing die and cradle die of a press apparatus. In th case of this in invention, since the width $W_{20}$ of the center section 20 of the bulge section 8 is less than the width $W_6$ of the engagement section 6 as described above, when performing the pressing process above, there is no shear force applied to both ends in the width direction (dot and dash line γ in FIG. 10) of the engagement section 6, which is formed on part of the connection section 3 in the width direction. Rather, a compression force is applied to both end sections between opposite end edges of the pressing die for forming the engagement section 6 and the part of the cradle die that faces the pressing die and which forms the inclined section 21 of the bulge section 8, and makes the structure of both end sections dense. As a result, no internal deformation that would cause damage such as crack ing occurs in the end sections, and so it is difficult for damage such as cracking to occur in both of the end sections in the width direction of the engagement section 6 even when large forces are repeatedly applied to the engagement section 6 over a long period of time.

Next, the construction, function and effect of another feature of the invention will be explained. The thickness of the aforementioned connection section 3 is the thinnest thickness "t" between the inclined sections 21 that are on both sides in the width direction of the bulge section 8, and the corner sections 22 of the engagement section 6. In contrast, the thickest thickness T is between the center section 20 of the bulge section 8 and the engagement section 6. In the case of this sheet-metal rocker arm, the ratio t/T of the thicknesses t and T is 0.5 or greater.

By making the ratio t/T between the thickness t at the thinnest part of the connection section 3 and the thickness T at the thickest part 0.5 or greater, the force applied to the connection section 3 becomes uniform, while the sheet-metal rocker arm 1 is in operation which makes it possible to even more effectively prevent damage to the connection section 3. In other words, when the t/T is too small, stress is concentrated at the areas between the inclined section 21 and the corner sections 22 of the engagement section 6 when the sheet-metal rocker arms is in operation, making it easy for damage such as cracking to occur in those areas. Table 1 below shows the test conditions and the results for tests that were performed to find out the effect that the ratio t/T has on durability of these areas.

TABLE 1

| | 1 | 2 | 3 | 4 | 5 | 6 | 7 | 8 | 9 | 10 |
|---|---|---|---|---|---|---|---|---|---|---|
| Thickness T | 3.50 | 3.75 | 3.60 | 3.65 | 3.45 | 3.55 | 3.60 | 4.60 | 4.50 | 4.40 |
| Thickness t | 2.55 | 1.70 | 2.20 | 2.70 | 2.55 | 2.65 | 2.70 | 2.65 | 2.84 | 2.65 |
| Ratio t/T | 0.73 | 0.45 | 0.61 | 0.74 | 0.74 | 0.75 | 0.75 | 0.58 | 0.63 | 0.60 |
| Result | ○ | X | ○ | ○ | ○ | ○ | ○ | ○ | ○ | ○ |

In this test, 10 samples were prepared having different ratios t/T a nd an endurance test was performed under the same conditions similar to the actual operating conditions {a compression force of 1051.54 N (107.3 kgf) was repeatedly applied to the engagement section 6*a*}. In Table 1, the numerical values for the thicknesses t and T are in the unit of rm. Also, of the codes showing the test results, '○' indicates that no damage due to cracking occurred, and 'X' indicates that damage did occur. As can be clearly seen from the test results in Table 1, damage occurred when the ratio t/T was less than 0.5, however became difficult to occur when the ratio t/T was 0.5 or greater. Accordingly, when the width $W_{20}$ of the center section 20 is less than the width $W_6$ of the engagement section 6, and the ratio t/T is 0.5 or greater, it is possible to improve the durability of the sheet-metal rocker arm even more.

Figure 11:
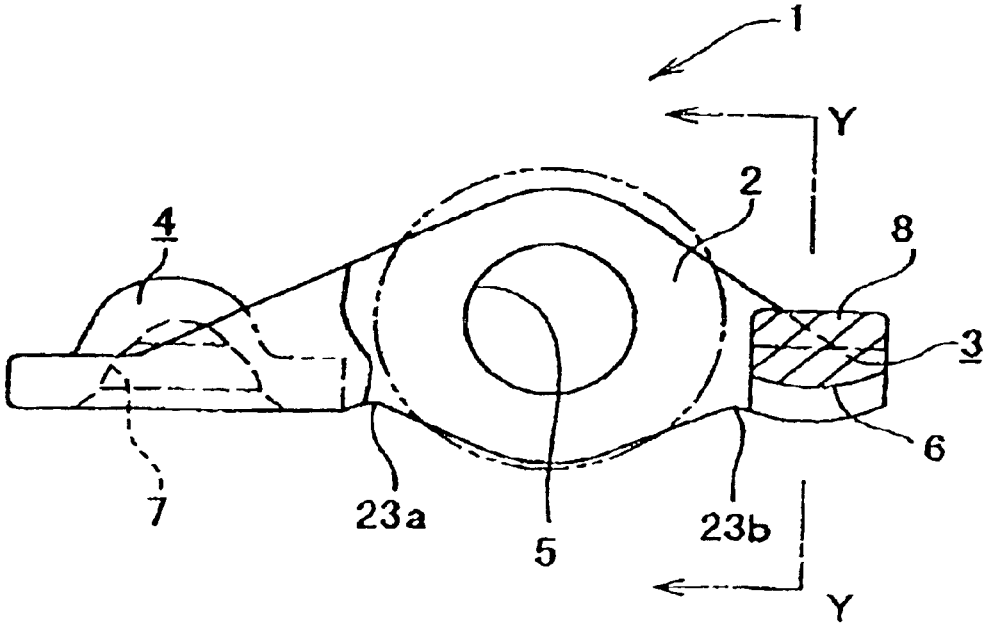
FIG. 11 is a partially cross sectional side view to show a second example in the embodiment of the present invention.
Figure 12:
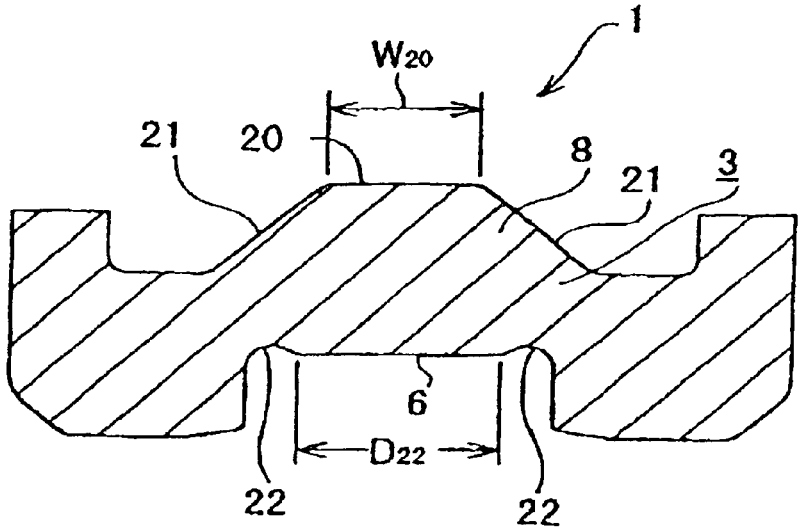
FIG. 12 is an enlarged cross sectional view taken along the line Y—Y in FIG. 11.
Figure 13:
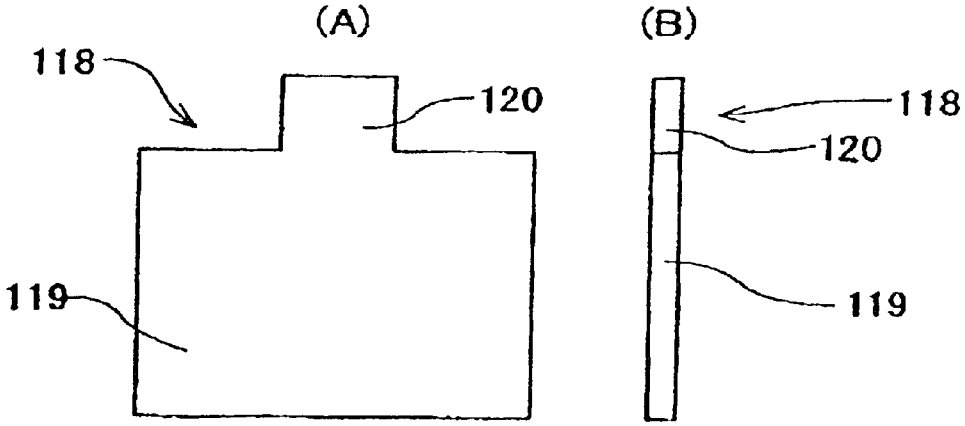
FIG. 13 is to show a first blank produced in the first step in the first example of the embodiment of the present invention, wherein (A) is a plan view and (B) is a side elevational view with reference to (A).

Next, FIGS. 11 and 12 show a second example of the embodiment of the sheet-metal rocker arm of this invention. In the case of the sheet-metal rocker arm 1 of this example, the depth of the groove-shaped corner sections 22 on both sides in the width direction of the engagement section 6 is less than in the case of embodiment 1 described above, and the width $W_{20}$ of the center section 20, which corresponds to the top of the trapezoidal cross section of the bulge section 8, is less than the distance $D_{22}$ between both corner sections 22. The amount that the width $W_{20}$ of the center section 20 is less than the distance $D_{22}$ between both corner sections 22, is also regulated within a range such that no internal shear stress is applied to the connection section 3 during the pressing process of the engagement section 6. For example, the width $W_{20}$ of the center section 20 is 80% or less than the distance $D_{22}$ between both corner sections 22 of the engagement section 6 ($W_{20} \leqq 0.8\ D_{22}$), and even more preferable, 60% or less ($W_{20} \leqq 0.6\ D_{22}$).

In the case of the embodiment constructed as described above, it is possible to effectively prevent unwanted stress from occurring in the connection section 3 when forming the engagement section 6. In other words, when forming the engagement section 6, part of the connection section 3 is pressed up a little as shown in FIGS. 11 and 12 when forming both corner sections 22. In the case of this embodiment, the entire corner sections 22 are located in the part that corresponds to the inclined sections 21 of the bulge section 8, so forces that occur when forming the corner sections 22 do not cause shear stress which is harmful from the aspect of securing durability.

Furthermore, in the case of the sheet-metal rocker arm 1 of this embodiment, the constricted sections 12*a*, 23*b* that are formed in the area next to the connection section 3 and second connection 4 in the middle of one edge (lower edge in FIG. 11) of the left and right side wall sections 2 are smaller than in the first embodiment described above, the position of the innermost end (the top of the arc) of these constricted sections 23*a*, 23*b* is shifted downward in FIG. 11. Also, the length between these constricted sections 23*a*, 23*b* and the peripheral edge of the circular holes 5 for supporting both ends of the pivot shaft for roller support is made longer. A large force is applied to the inner peripheral surface of the circular hole 5 as the end of the pivot shaft is fitted inside the circular hole 5 and spread by crimping, and therefore tensile stress due to the large force is applied to the portion between these constricted sections 23*a*, 23*b* and the peripheral edge of the circular hole 5. However, as this distance is lengthened, the stress in this portion is lessened, thus making it more difficult for damage due to cracking to occur in this portion. In the case of the sheet-metal rocker arm 1 of this invention, this construction makes it possible to improve the durability even more when compared with the first embodiment described above.

Figure 7:
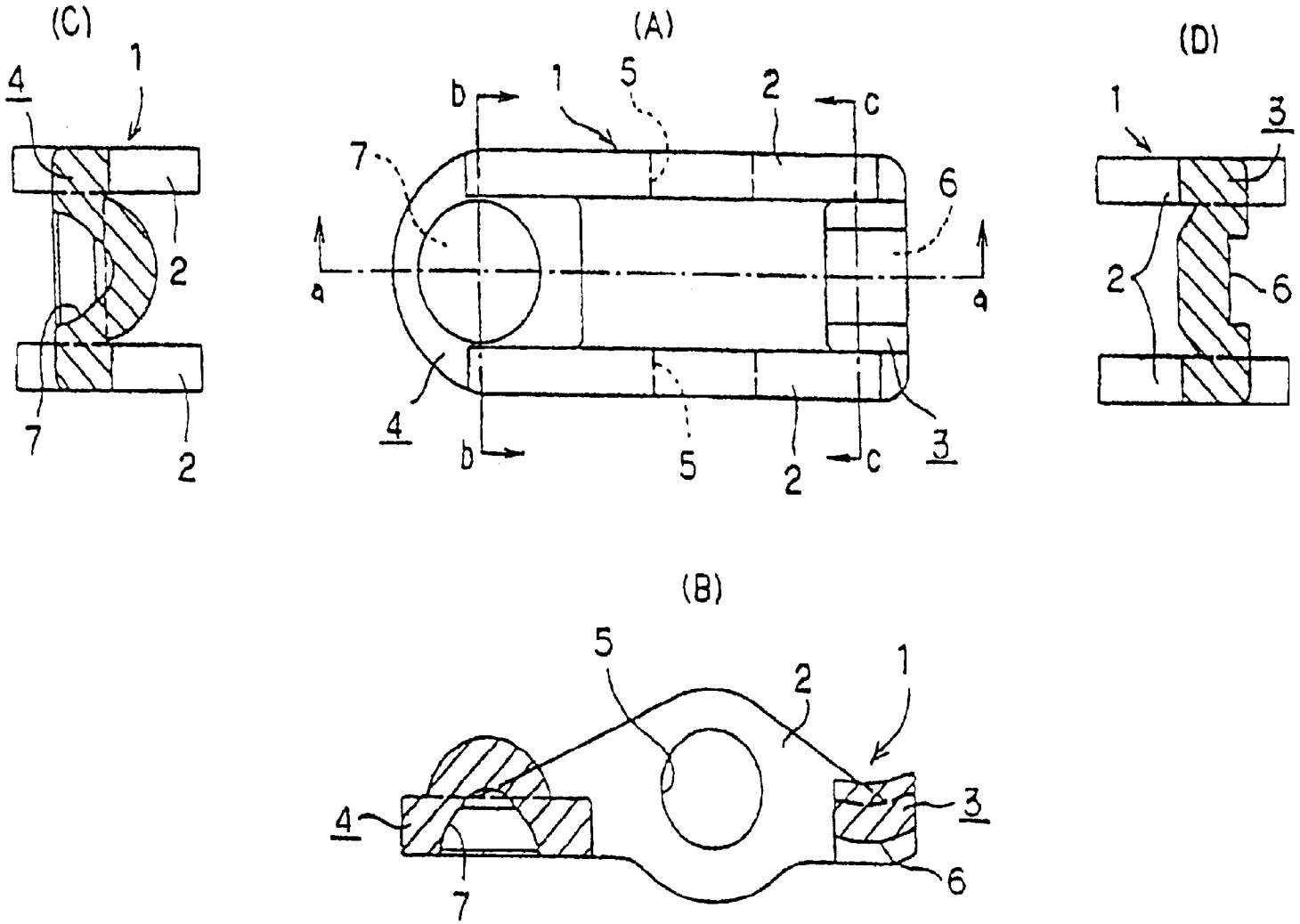
FIG. 7 is to show a second blank sheet obtained by the second step of the second step of the previous invention, wherein (A) is a plan view, (B) is a cross sectional view taken along the line a—a in the (A), (C) is a cross sectional view taken along the line b—b in the (A), and (D) is a cross sectional view taken along the line c—c in the (A).
Figure 8:
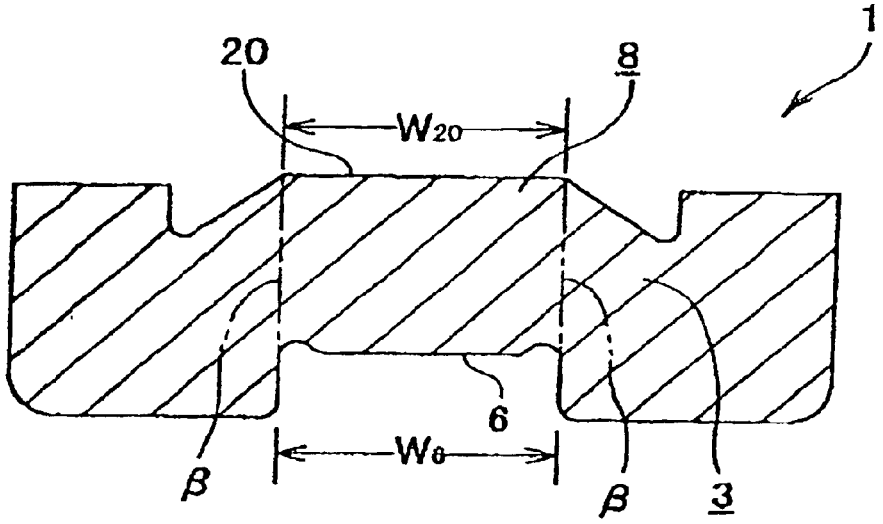
FIG. 8 is an enlarged view of the cross sectional portion in FIG. 7(D).

FIGS. 13 to 25 show a first example of the manufacturing method for the sheet-metal rocker arm of this invention. A feature of this invention is in a method for sufficiently increasing the thickness $t_3$ of the connection section 3 in order to sufficiently secure the durability of the connection section 3 and to improve the strength of the engagement section 6, even when the force applied to the engagement section 6 becomes large due to an increased elastic force of the valve spring, which energizes the valve unit the base end of which comes in contact with the engagement section 6 that is formed on one surface of the connection section 3 (see FIGS. 22 and 23). The construction of the other parts of the sheet-metal rocker arm that is manufactured by the manufacturing method of this invention is the same as for the sheet-metal rocker arm 1 of the previous invention shown in FIGS. 1 and 7, so any redundant explanation will be omitted or simplified. The explanation below will center on the features of this invention.

In the case of manufacturing a sheet-metal rocker arm with the manufacturing method of this invention, first, in a first process, a first blank 118 is made as shown in FIG. 13(A) and FIG. 13(B). That is, in this first process, a sufficiently rigid metal sheet (flat sheet or coiled sheet), such as carbon steel sheet having a thickness of 3 to 4 mm, is supplied between the punching die and cradle die of a press apparatus not shown in the figure, and the first blank 118 is punched out and formed between these dies. As shown in FIG. 13(A), this first blank has a square or rectangular main section 119 and a square or rectangular protruding section 120 that is formed at the center of one edge (top edge in FIG. 13(A)) of the main section 119. This protruding section 120 protrudes from the part of the first blank 118 that will become the engagement section 6, specifically from the edge adjacent to the center of the top edge of the main section 119 shown in FIG. 13(A).

Figure 14:
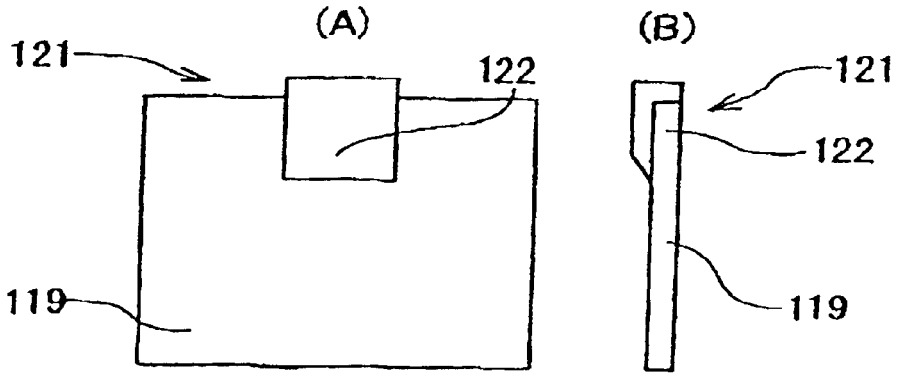
FIG. 14 is to show a second blank produced in the following step, wherein (A) is a plan view, and (B) is a side elevational view with reference to (A).

Next, in a second process, by performing the thickness-increasing process, called upsetting, which is a feature of this invention, on the first blank 118 described above, a second blank 121 is formed as shown in FIG. 14(A) and FIG. 14(B). This thickness-increasing process is performed by pressing the protruding section 120 shown in FIG. 13(A) in the surface direction of the first blank 118 (downward in FIG. 13(A) to FIG. 14(B)) toward the edge of the main section 119, which will become the engagement section 6. In other words, the main section 119 of the first blank 118 is set on a cradle die (not shown in the figure) that has a shape corresponding to the shape of the second blank 11, and the protruding section 120 is pressed by the pressing die (also not shown in the figure) toward the main section 119. The main section 119 is tightly fitted onto the cradle die such that only the thickness of the space of the section that corresponds to the engagement section 6 is increased by the amount corresponding to that of the engagement section 6. By strongly pressing the protruding section 120 with the pressing die toward the main section 119, with the main section 119 of the first blank 118 set into the cradle die in this way, the thickness in the center of the edge of the main section 119, which will become the engagement section 6, is increased to obtain the second blank 121 as shown in FIGS. 14(A) and 14(B). This second blank 121 has a thick section 122 formed in the area in the center of the edge of the main section 119, which will become the engagement section 6, where the thickness is greater than the thickness of the other parts.

Figure 15:
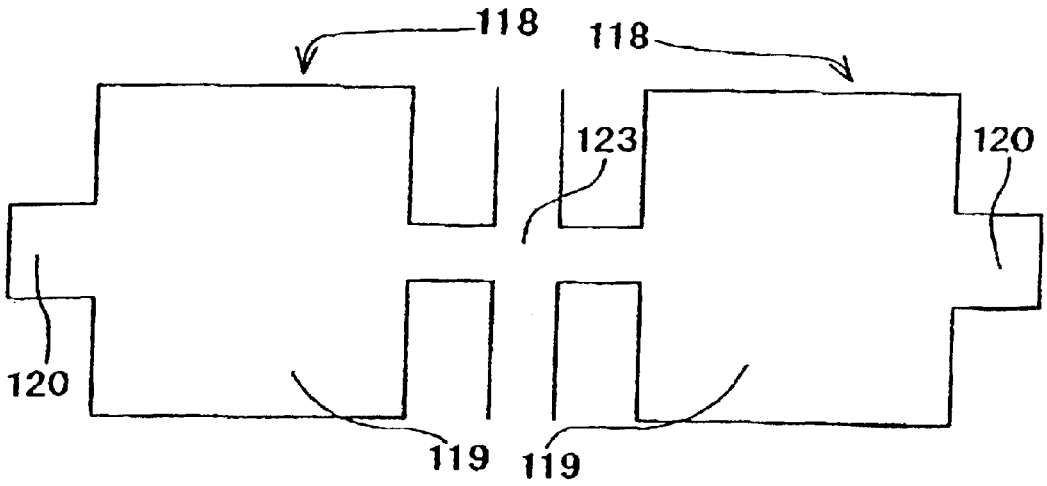
FIG. 15 is a plan view to show another example of a second blank under processing.
Figure 16:
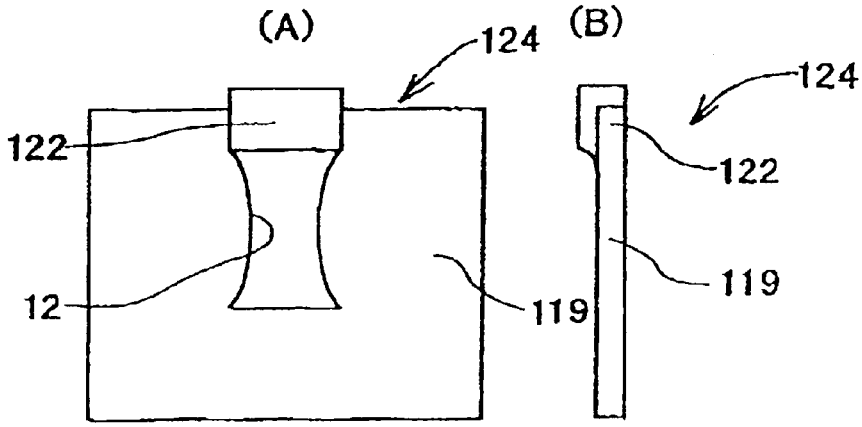
FIG. 16 is to show a third blank produced in the following step, wherein (A) is a plan view, and (B) is a side elevational view.
Figure 17:
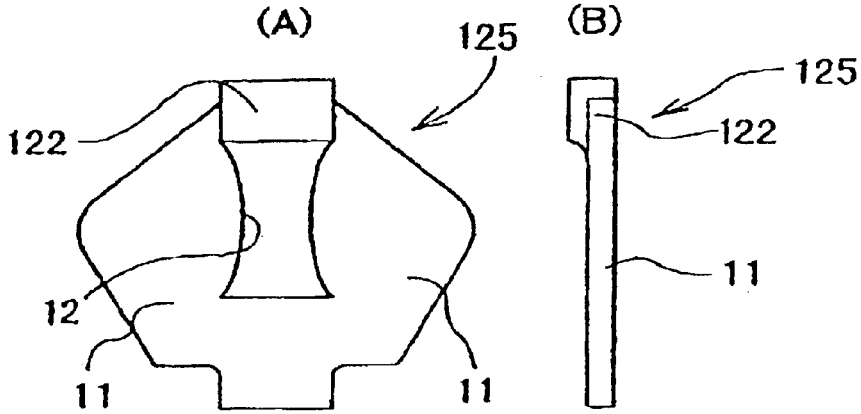
FIG. 17 is to show a fourth blank produced in the following step, wherein (A) is a plan view, and (B) is a side elevational view.

In this second process, when strongly pressing the protruding section 120 toward the main section 119, by providing a pair of first blanks 118, as shown in FIG. 15, and by pressing the protruding sections 120 that protrude from opposite sides of the pair of first blanks 118 in a direction toward each other, it is possible to reduce the rigidity of the portion that receives the force in this pressing work, or in other words, of the portion that supports the cradle die, and thus it is possible to simplify and lower the cost of the equipment.

In other words, by feeding an elongated sheet of metal material from an uncoiler and by performing a sequential punching process in synchronization with the feeding of this metal material, a continuous section 123 is formed such that it is located in the center in the width direction of this metal material, and a pair of opposing first blanks 118 are formed such that they extend from both edges in the width direction (left and right direction in FIG. 15) of this continuous section 123 specifically from the portion where the phase in the length direction (up and down direction in FIG. 15) of each side matches each other, outward in opposite directions. Then by pressing both of the protruding sections 120 of the opposite sides of these first blanks 118 in a direction toward each other, the thickness of part of these first blanks 118 is increased to form the aforementioned second blanks 121. Also, in any of the processes that are performed after this process of increasing the thick ness, these second blanks 121 may be cut and removed from the continuous section 123.

By forming these first blanks 118 into second blanks 121 as described above, it is possible to prevent the cradle dies from being moved even when the support rigidity of the cradle dies, in which the main sections 119 of these first blanks 118 are set, is decreased. In other words, with these cradle dies abutted to each other directly or by way of another connection member, the forces that are applied to the cradle dies from the pressing dies by way of the first blanks 118 cancel each other out. Therefore, it is possible to decrease the rigidity of the part that supports these cradle dies as described above and simplify the equipment and lower the cost thereof. This technique is not limited to the manufacture of a sheet-metal rocker arm, but can be applied to manufacturing methods of manufacturing all kinds of parts in which the thickness of the part of the sheet metal is increased by an upsetting process. Also, the pair of blanks can be formed in any manner to be symmetrical on both sides of a joint such as a connection section, and does not necessarily have to be made by being punched out from a long piece of sheet metal fed from an uncoiler.

In any ca se, in the third process that follows, a punching process (piercing) is performed on the second blank 121, shown in FIGS. 14(A) and 14(B), to form a third blank 124 as shown in FIGS. 16(A) and 16(B). That is, in the third process, an hourglass-shaped through hole 11 is formed in the center of the second blank 121 such that it has nearly the same width as the thick section 122, and such that it matches the thick section 122 in the phase with respect to the width direction of the second blank 121.

Figure 3:
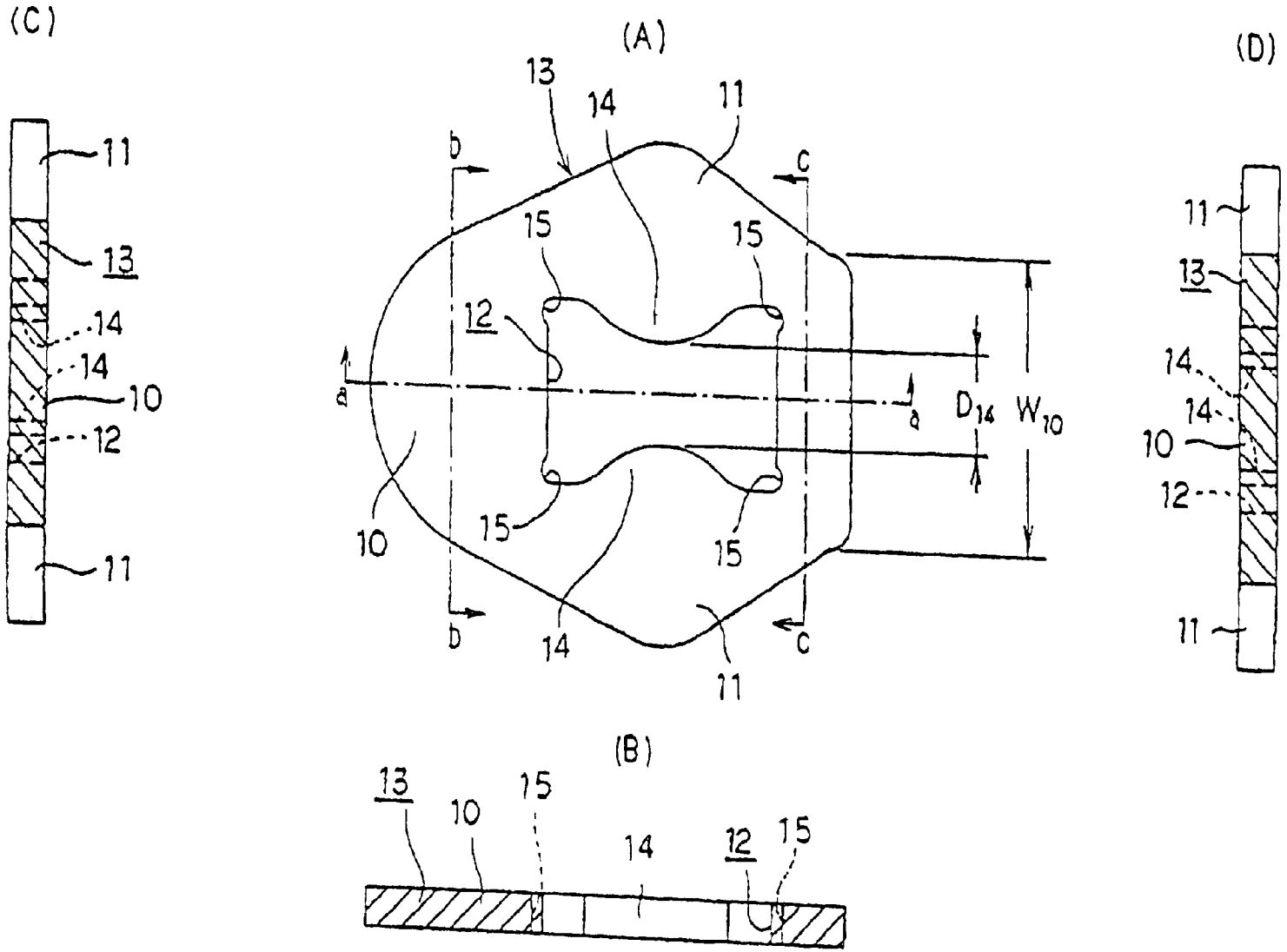
FIG. 3 is to show a second blank sheet obtained by the second step of the second step of the previous invention, wherein (A) is a plan view, (B) is a cross sectional view taken along the line a—a in the (A), (C) is a cross sectional view taken along the line b—b in the (A), and (D) is a cross sectional view taken along the line c—c in the (A).
Figure 4:
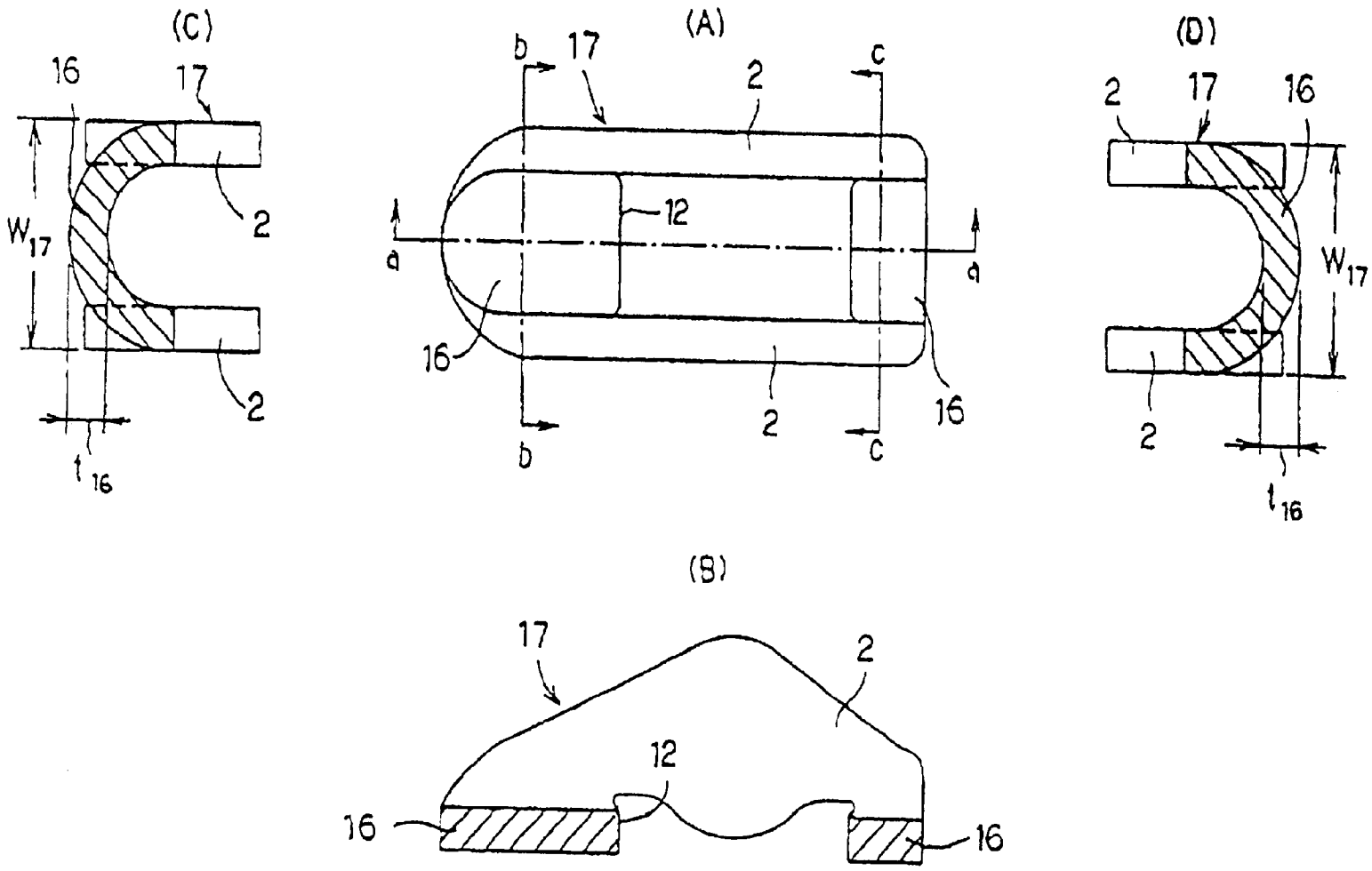
FIG. 4 is to show a first blank sheet obtained by the second step of the second step of the previous invention, wherein (A) is a plan view, (B) is a cross sectional view taken along the line a—a in the (A), (C) is a cross sectional view taken along the line b—b in the (A), and (D) is a cross sectional view taken along the line c—c in the (A).

Chamfering is performed on the third blank 124, manufactured as described above, to remove any burrs from the peripheral edge of the through hole 11, and then in a fourth process, trimming and cutting process are performed to remove any excess material around the peripheral edge of the main section 119 whereby a fourth blank 125 is formed as shown in FIGS. 17(A) and 17(B). The shape of this fourth blank 125 is nearly the same as the second blank 13 (see FIG. 3) of the aforementioned previous invention, except that the thickness of the connection section 3 that will become the engagement section 6 has already been increased.

The construction of the press apparatus for performing the processes described above is not especially set, however, from the aspect of improving processing efficiency, it is preferable that a sequential-feed press is used for performing the processes from the first blank 118 shown in FIGS. 13(A) and 13(B) to the fourth blank 125 shown in FIGS. 17(A) and 17(B). In the case of a sequential-feed press that uses a single die for multiple processes, it is possible to improve the processing efficiency because it is possible to reduce the amount that the object being processed must fed. On the other hand, in the bending process described later and as shown in FIGS. 18 to 25, a transfer press is preferred. In a transfer press, the dies used in each processes are different, so it is difficult to improve the processing efficiency since the amount that the object being processed must be fed increases, however, since the it is easier to manufacture the dies used, it is possible to reduce the costs by reducing equipment costs.

Chamfering is performed on the fourth blank 125 that is manufactured as described above in order to remove the burrs around the outer peripheral edges, and then this fourth blank 125 is annealed in an annealing process. By annealing this fourth blank 125, it is possible to soften the part that was hardened by work-hardening when performing the pressing work to form the thick section 122, and thus it is possible to remove any residual stress in the fourth blank 125 that occurred due to that pressing work. Therefore, it not only becomes easier to perform the work of forming the side wall section 2 (see FIGS. 20 to 25) in the following processes, but it is also possible to effectively prevent damage such as cracking from occurring in the bent sections. When necessary, in addition to the annealing process, multiple fourth blanks 125 may be rubbed together and processed by barrel processing to remove any scales from the surface that occurred due to the annealing process, and to remove any burrs remaining on the edges.

Figure 18:
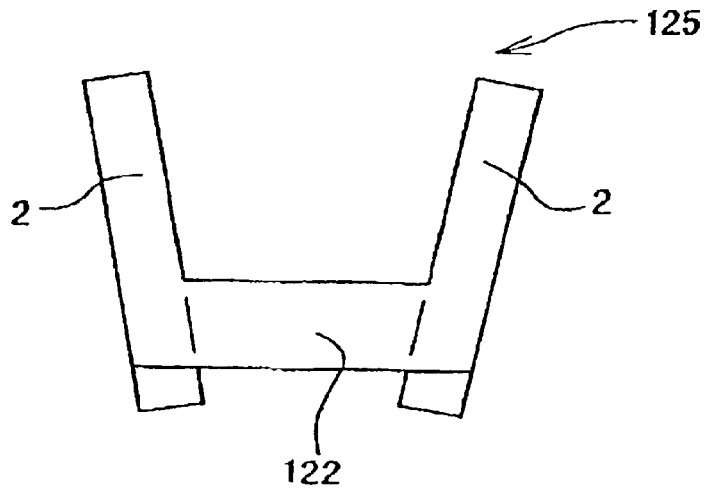
FIG. 18 is an end view to show a state during a process to produce a first intermediate blank in the following step.
Figure 19:
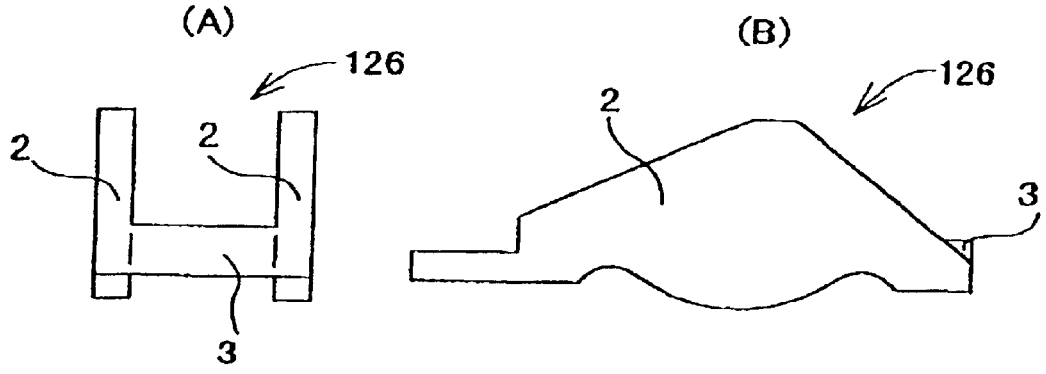
FIG. 19 is to show the first intermediate blank obtained, wherein (A) is an end view, and (B) is a side elevational view.
Figure 20:
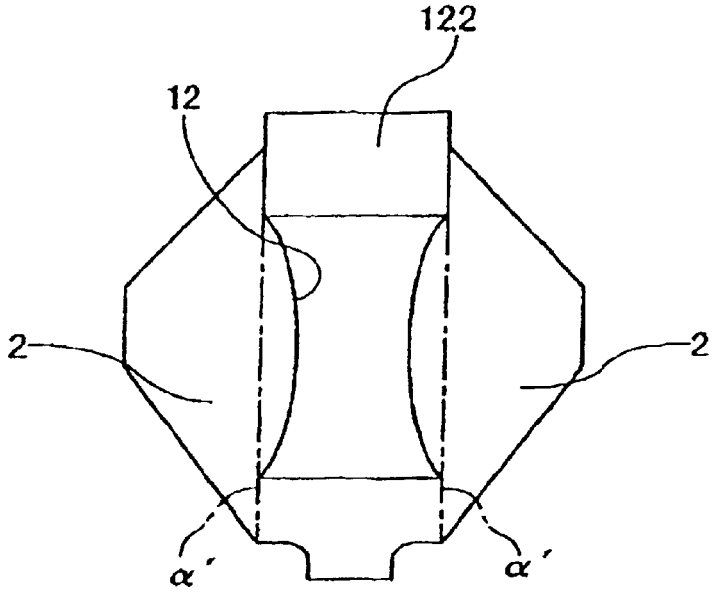
FIG. 20 is a plan view to show a bending position upon producing the first intermediate blank from the fourth blank.
Figure 21:
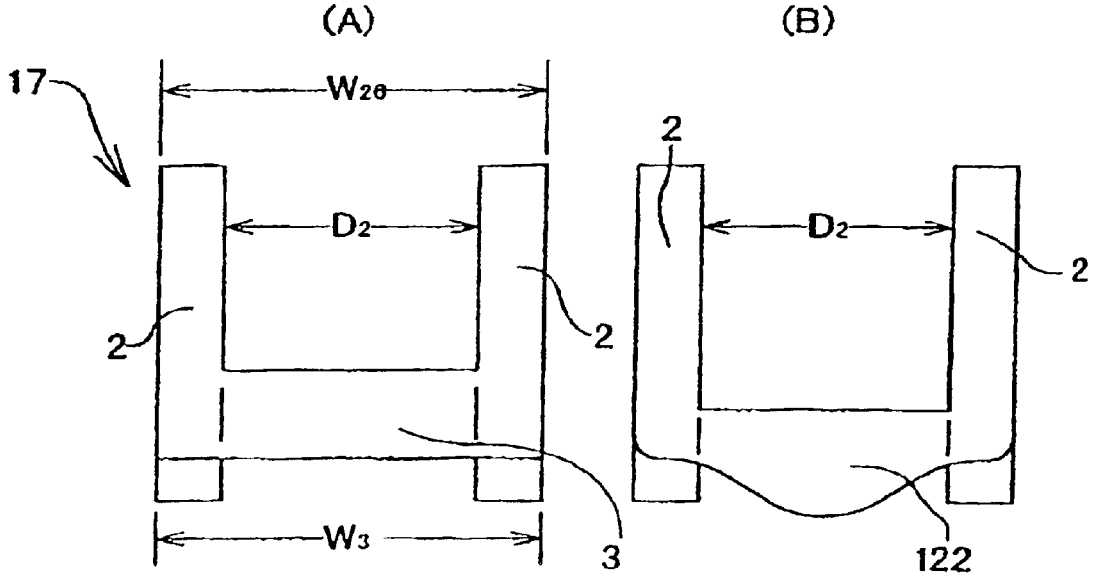
FIG. 21 is an end view of the intermediate blank to show that the pre-state and post-state of the bending process and thickening process affect the width of the thickened portion.

After the fourth blank 125 has been annealed as described above, both ends in the width direction of this fourth blank 125 are bent in the same direction as in the aforementioned previous invention, to form a pair of side wall sections 2 that are parallel with each other. This bending process is performed, as shown in FIGS. 18 and 19, by a transfer press (not shown in the figures). When performing this bending process, the locations of the bending (corners on the inner peripheral side of the bend) are at two locations of the fourth blank 125 such that the through hole 11 is in between them, or as shown be the dot-dash lines α' in FIG. 20, at locations that nearly correspond with the through hole 11 and both edges in the width direction of the thick section 122. In other words, both edges in the width direction of the fourth blank 125 are bent in the same direction with the dot-dash lines α'being the corners on the inner peripheral side to form the aforementioned pair of side wall sections 2 to provide a first intermediate blank 126 as shown in FIGS. 19(A) and 19(B).

When making this first intermediate blank 126, the location of bending when forming the side wall sections 2 as described above is along the dot-dash line α' in FIG. 20, and nearly corresponds with the through hole 11 and both ends in the width direction of the thick section 122, so not only is it possible to easily perform the work of forming the side wall sections 2, but it is also possible to effectively prevent damage such as cracking from occurring in the bent sections.

Moreover, as shown in FIG. 21(A), of the obtained first intermediate blank 126, the width $W_3$ of the connection section 3 that corresponds to the thick section 122 is greater than the distance $D_2$ between the pair of side wall sections 2 of the first intermediate blank 126, and up to the width $W_{17}$ of the first intermediate blank 17 ($W_{17} \geqq W_3 \geqq D_2$). By making the width $W_3$ of the connection section 3 greater than the distance $D_2$ between the pair of side wall sections 2, it is difficult for damage such as cracking to occur in the engagement section 6 of the connection section 3 even when large force is applied in the thickness direction of the engagement section 6. By performing the thickness-increasing process with upsetting for the part corresponding to the connection section 3 after bending the wall sections 2, the width of the thickness section 122 becomes less than the distance $D_2$ between the pair of side wall sections 2, so it becomes difficult to secure sufficient durability when a large force is applied to the engagement section formed on the thick section 122.

Figure 22:
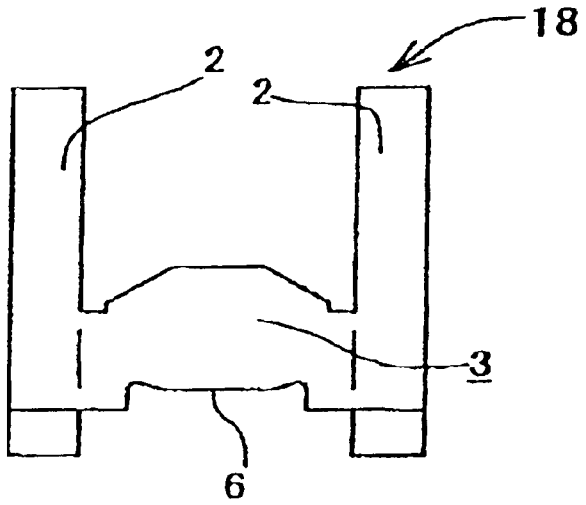
FIG. 22 is an end view to show a state during the process to obtain the second intermediate blank.
Figure 23:
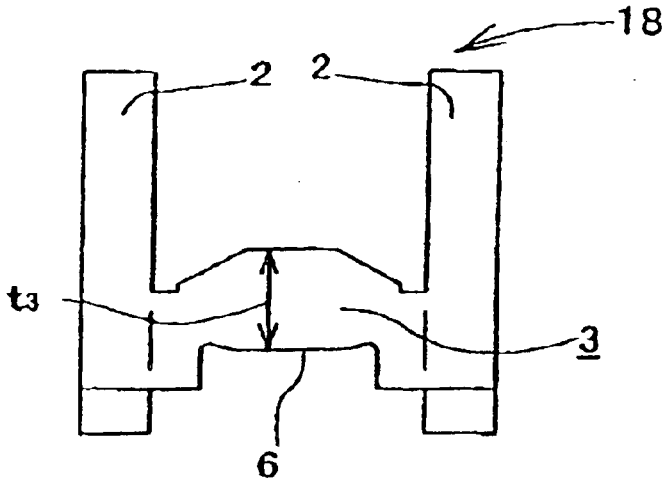
FIG. 23 is an end view of the second intermediate blank obtained.
Figure 24:
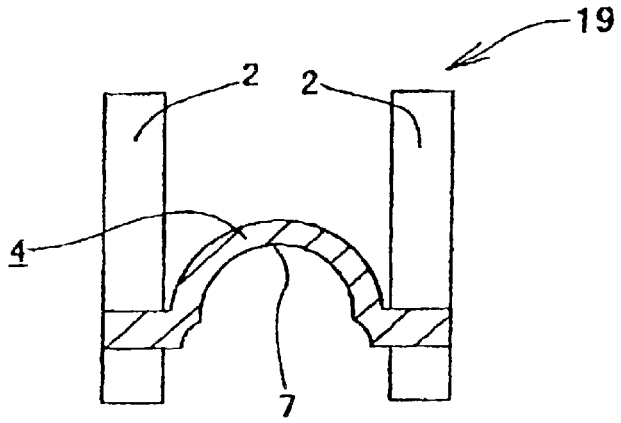
FIG. 24 is a cross sectional view to show a state during the process to obtain the third intermediate blank.
Figure 25:
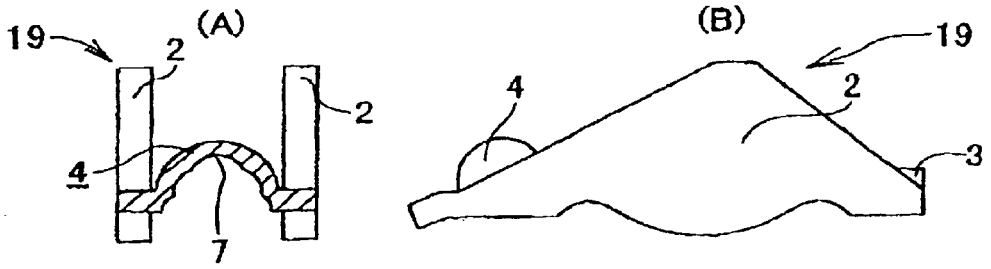
FIG. 25 is to show the third intermediate blank obtained, wherein (A) is a cross sectional view, and (B) is a side elevational view.

An engagement section 6 is formed on the connection section 3 of this first intermediate blank 126, as shown in FIGS. 22 and 23, to form a second intermediate blank 127, and a second engagement section 7 is formed on the second connection section 4, as shown in FIGS. 24 and 25, to form a third intermediate blank 128. It does not matter whether the work of forming the engagement section 6 is performed before or after the work of forming the second engagement section 7. Also, circular holes 5 (see FIG. 1 and FIG. 7) are formed at corresponding locations in alignment in the pair of the side wall sections 2, to form the final shape of the sheet-metal rocker arm.

After forming the final shape of the sheet-metal rocker arm as described above, heat treatment such as carbonization is performed in order to harden the surface of the sheet-metal rocker arm. After heat treatment, processing to remove the intergranular oxidation layer on the surface of the sheet-metal rocker arm is performed. This process for removing the intergranular oxidation layer is performed by a method of striking the surface of the sheet-metal rocker arm with particle matter like media, such as in shot blast or barrel processing.

By performing a process to remove the intergranular oxidation layer on the surface of the sheet-metal rocker after performing heat treatment to harden the surface, it is possible to remove minute grooves that could cause damage such as cracking, and thus making it possible to improve the durability of the sheet-metal rocker arm. In other words, there are minute grooves on the surface of the intergranular oxidation layer, so if the intergranular oxidation layer is left as is, it becomes easy for damage such as cracking to occur from the minute grooves during use. Therefore, the rocker arm is treated by the aforementioned process to remove the intergranular oxidation layer and minute grooves and make it more difficult for damage to occur. By performing the process for removing the intergranular oxidation layer using a method of striking the surface of the sheet-metal rocker arm with particle matter like media, such as in shot blast or barrel processing, residual compression stress occurs in the surface layer of the sheet-metal rocker arm, and it is possible to even more effectively prevent the occurrence of damage such as cracking.

In the case of the sheet-metal rocker arm constructed as described above, the necessary finishing processes, such as polishing, have been performed for the surface of the engagement section 6 that comes in contact with the base end of the valve unit during use, and for the surface of the second engagement section that comes in contact with the tip end of a rush adjuster during use, and then the pivot shaft and roller are installed. With the method of increasing thickness, which is a feature of this invention, it is also possible to increase the thickness of other engagement section and not just for the valve engagement sections. Also, in the case of a mechanical-adjustment-type sheet-metal rocker arm, in which a screw hole is formed in the pivot engagement section and an adjustment screw is screwed into that hole, it is possible to secure the screw length between the screw hole and adjustment screw and increase the strength of that section.

Application to the Industry

This invention is constructed and functions as described above, and makes it possible to manufacture a lightweight and low-cost sheet-metal rocker arm having sufficient durability, and thus makes it possible to reduce the cost and improve the performance of the engine in which the rocker arm is installed.

What is claimed is:

1. A sheet-metal rocker arm formed by punching one sheet of sheet metal to form a blank having a specified shape and through holes, and by performing a bending process for this blank based on a press process, and comprising a pair of nearly parallel side wall sections each having an edge in the width direction and a connection section that connects the edges in the width direction of both of these side wall sections, and the side wall sections having at least one pair of circular holes formed at corresponding locations in alignment, and the connection section having an engagement section formed on one surface thereof by deforming in the thickness direction the middle of the connection section, such that it is more concave than the other surface of the connection section, and a bulge section provided on the other surface thereof by being protruded in an embanked shape as this engagement section is formed, the bulge section having a trapezoidal cross-section, wherein the center section of the bulge section, which corresponds to the top surface of the trapezoid, has bo th edges in the width direction located further inside in the width direction than both edges in the width direction of the engagement section.

2. The sheet-metal rocker arm of claim 1, wherein the thickness of the engagement section is made greater than the thickness of both side wall sections by increasing the thickness of the connection section in which the engagement section is formed.

3. The sheet metal rocker arm of claim 2, wherein with the thicknesses of the connection section, the ratio t/T of the thickness t of the thinnest section, that is the distance between the inclined section on both sides in the width direction of the bulge section and the corner sections of the engagement section, with respect to the thickness T of the thickest section that is the distance between the center of the bulge section and the engagement section, be 0.5 or greater.

4. A manufacturing method for manufacturing a sheet-metal rocker arm formed by punching one sheet of sheet metal to form a blank having a specified shape and through holes, and by performing a bending process for this blank based on a press process, and comprising a pair of nearly parallel side wall sections each having an edge in the width direction and a connection section that connects the edges in the width direction of both of these side wall sections, and the side wall sections having at least one pair of through holes formed at corresponding locations in alignment, and the connection section having at least one engagement section formed on one part thereof, wherein the thickness of the engagement section in the connection section is larger than the thickness of the both side wall sections, comprising a process wherein a protruding section is formed to protrude from the end next to the part of the blank that becomes the engagement section, in the surface direction of the blank toward the part that becomes the engagement section, and after the thickness of this part has been increased, for forming the engagement section in the part, in which there is a bulge section having a trapezoidal cross-section, wherein the center section of the bulge section, which corresponds to the top surface of the trapezoid, has both edges in the width direction located further inside in the width direction than both edges in the width direction of the engagement section.

5. The manufacturing method of claim 4, wherein a pair of blanks are formed by performing a punching process on a metal material, and a continuous section is formed such that it is located in the center in the width direction of the metal material, and such that the blanks extend outward in opposite directions from both edges in the width direction of the continuous section, and then by pressing both of the protruding sections on the opposite sides of these blanks in pair in a direction toward each other, the thickness of part of these blanks is increased, and then the blanks are cut and removed from the continuous section.

6. The manufacturing method of claim 4, wherein after increasing the thickness of part of the blank that will become the engagement section, it is annealed in an annealing process after a through-hole is formed in the center of this blank, and before the blank is bent at two locations with the through-hole therebetween in the same direction to form a pair of side wall sections.

7. The manufacturing method of claim 4, wherein after the thickness of the part of the blank that will become the engagement section has been increased, a through-hole is formed in the center of this blank such that width is nearly the same as that of the thickness-increased section, and such that the phase in the width direction of the blank corresponds with that of the thickness increased section, and then, the blank is bent at two locations with the through-hole therebetween in the same direction, at the section where the thickness is increased and at the section that nearly corresponds to both edges in the width direction of the through-hole, to form a pair of side wall sections, wherein the places that are bent when forming the side wall sections are on the section where the thickness was increased and the section that nearly corresponds to both edges in the width direction of the through-hole.

8. The manufacturing method of claim 4, wherein after the sheet-metal rocker arm is processed to its final form, heat treatment is performed for hardening the surfaces of the sheet-metal rocker arm, and then processing is performed to remove to the intergranular oxidation layer from the surface of the sheet-metal rocker arm.

* * * * *